US007205467B2

(12) United States Patent
Tafolla et al.

(10) Patent No.: US 7,205,467 B2
(45) Date of Patent: Apr. 17, 2007

(54) STRAP WITH ACCESSORY

(75) Inventors: Joseph A. Tafolla, 5412 Bolsa Ave., Unit E., Huntington Beach, CA (US) 92649; Jameson Laialoha Mathis, Costa Mesa, CA (US)

(73) Assignee: Joseph A. Tafolla, Huntington Beach, CA (US)

( * ) Notice: Subject to any disclaimer, the term of this patent is extended or adjusted under 35 U.S.C. 154(b) by 0 days.

(21) Appl. No.: 11/032,265

(22) Filed: Jan. 10, 2005

(65) Prior Publication Data

US 2006/0150798 A1 Jul. 13, 2006

(51) Int. Cl.
*G10D 3/08* (2006.01)

(52) U.S. Cl. ..... 84/327; 84/329

(58) Field of Classification Search ..... 84/327, 84/329, 421

See application file for complete search history.

(56) References Cited

U.S. PATENT DOCUMENTS 4,254,901 A * 3/1981 McIntosh ..... 224/258
5,435,220 A * 7/1995 Pultz ..... 84/329
6,140,564 A 10/2000 Pia
6,199,731 B1 * 3/2001 Lehoux ..... 224/260
6,259,009 B1 7/2001 Bolo, III
6,624,346 B2 * 9/2003 Standish ..... 84/280
6,812,393 B1 * 11/2004 Wilfer ..... 84/453
2003/0066855 A1 * 4/2003 Stone ..... 224/673
2006/0096440 A1 * 5/2006 Weathersby ..... 84/322

* cited by examiner

*Primary Examiner*—Kimberly Lockett
(74) *Attorney, Agent, or Firm*—McDermott Will & Emery LLP

(57) ABSTRACT

A musical instrument strap assembly includes a musical instrument strap having ends configured to attach to a musical instrument. An accessory is attached to the musical instrument strap. In some arrangements, the accessory is configured to hold a lighter. In some arrangements, the accessory is a bottle opener. In some arrangements, the accessory is configured to hold a drink container. In some arrangements, the accessory is a receptacle configured to hold one or more items.

8 Claims, 19 Drawing Sheets

STRAP WITH ACCESSORY

BACKGROUND OF THE INVENTIONS

1. Field of the Inventions

The present invention relates generally to accessories and particularly to accessories that can be attached to a strap.

2. Description of the Related Art

Straps are commonly used for supporting an article by a person's body, thereby leaving the person's hands free to perform various tasks. Typically, a shoulder strap extends about a person's shoulders and neck and can be connected to an article, such as a purse, bag (e.g., a satchel, diaper bag, and backpack), and the like. Typically these articles have compartments that are not conveniently accessible when a person is wearing the article. For example, the storage compartments of a backpack may not be easily accessed by a person wearing the backpack. Thus, a person may have to remove the backpack in order to remove an item from the backpack.

Many times straps are used to support an instrument, especially stringed musical instruments (e.g., a guitar, bass guitar, mandolin, banjo, etc.). These stringed musical instruments are typically played while standing. The shoulder strap is usually positioned on the player's shoulder, such that the ends of the strap are connected to the instrument positioned in front of the musician. The central portion of the strap extends over and around the shoulder of the musician. Some instruments are heavy and therefore may be cumbersome to remove from the player's body during, e.g., a musical performance. Thus, the musician often wears the instrument by the strap while performing normal everyday tasks due to the difficulty in removing and replacing the instrument. For example, musicians may wear a musical instrument, such as a guitar, while they smoke (e.g., cigarettes) and/or ingest fluids.

Guitars are a popular musical instrument among musicians and audiences. The guitarist is usually highly visible during musical performances. A guitar strap typically holds a guitar so that the guitarist's left hand can grip the front board neck of the guitar, and the guitarist's right hand is usually used to strum the strings of the guitar with his fingers, or a pick. If the guitarist is sitting, the bottom or lower end of the guitar can rest upon the guitarist's thigh, and the guitar strap ensures that the guitar does not fall and hit the ground. Unfortunately, a guitarist may stop performing for an undesirable amount of time to perform normal tasks. Typically, the guitarist does not have convenient access to items, such as lighters, drink containers, guitar picks, bottle openers, and the like. For example, a guitarist may wear clothing that does not have compartments (e.g., pockets) for holding these items. Accordingly, the guitarist may have to stop performing and/or leave the performance area (e.g., a stage) to obtain a lighter for lighting a cigarette, a bottle opener for opening a bottle containing foodstuffs, and/or drinkware.

SUMMARY OF THE INVENTIONS

In some embodiments, a musical instrument strap assembly comprises a musical instrument strap that has ends configured to attach to a musical instrument. A holder is attached to the musical instrument strap and defines a chamber configured to receive and hold a lighter. In some embodiments, the holder defines an opening to the chamber. The opening is adapted to permit at least a portion of a lighter to slide into and out of the chamber. In some embodiments, the opening is adapted to receive a lighter that is substantially rectangular or elliptical in cross section. In one embodiment, the holder comprises a first sidewall, a second sidewall that is substantially parallel to the first sidewall, and a front portion. The front portion connects the first sidewall and second sidewall and a bottom. The front portion and sidewalls and musical instrument strap define a substantially rectangular cross section of the chamber. In some embodiments, the chamber can have a height of more than about 1 inch and a width less than a width of the musical instrument strap. In some embodiments, the chamber has a height of more than about 1 inch and a width less that extends over the edge of the strap by about ¼ inch on each side. In some embodiments, the holder is connected to a front portion of the musical instrument strap, and the front portion of the musical instrument strap is configured to be positioned in front a person when the person wears the musical instrument strap to support a musical instrument. In one embodiment, at least one fastener extends through the musical instrument strap and is attached to the holder. In some embodiments, a substantial portion of the holder is substantially rigid such that the holder retains its shape when a lighter is not disposed in the chamber.

In some embodiments, a musical instrument strap assembly comprises a musical instrument strap that is configured to attach to a musical instrument. The strap assembly also comprises an accessory that comprises a bottle opener. The accessory is coupled to the musical instrument strap. In some embodiments, the accessory is configured to remain coupled to the musical instrument strap when the bottle opener is used to open drinkware. In some embodiments, the accessory remains coupled to the musical instrument when the bottle opener grasps and removes a cap from a bottle. In some embodiments, the bottle opener comprises a corkscrew. In some embodiments, the strap assembly further comprises at least one fastener that extends through the musical instrument strap and is attached to the accessory.

In some embodiments, a musical instrument strap assembly comprises a strap and a receptacle. The strap is configured to attach to at least one end of a musical instrument. The receptacle is configured to be attached to the strap. The receptacle comprises a base and a lid that define a closed chamber. The chamber is configured to hold loosely a plurality of guitar picks. In some embodiments, the lid is pivotally connected to the base. In some embodiments, the lid and base cooperate to define the closed chamber when the lid is in a closed position. In some embodiments, the base defines an opening configured to permit person's thumb and finger to be passed therethrough. In some embodiments, the strap assembly comprises at least one fastener that extends through the musical instrument strap and is attached to the base.

In some embodiments, a musical strap assembly comprises a strap and a holder. The strap is configured to attach to at least one end of a musical instrument. The holder is configured to be attached to the strap and to hold a drink container. In some embodiments, the drink container comprises a flask. In some embodiments, the holder comprises a chamber that is sized to receive at least a portion of a drink container. In some embodiments, the holder is adapted to permit a drink container to be slid into and out of the holder.

In some embodiments, a musical instrument strap assembly comprises a musical instrument strap and a holder. The musical instrument strap has ends configured to attach to a musical instrument. The holder is attached to the musical instrument strap and defines a chamber configured to receive and hold a cosmetic container. In one embodiment, the holder comprises an elongated chamber configured to hold a lipstick. In another embodiment, the holder is adapted to permit a drink container to be slid into and out of the holder.

BRIEF DESCRIPTION OF THE DRAWINGS

These and other aspects of the inventions will be readily apparent from the detailed description below and the appended drawings, which are meant to illustrate and not to limit the invention, and in which.

DETAILED DESCRIPTION OF THE PREFERRED EMBODIMENTS

Figure 1:
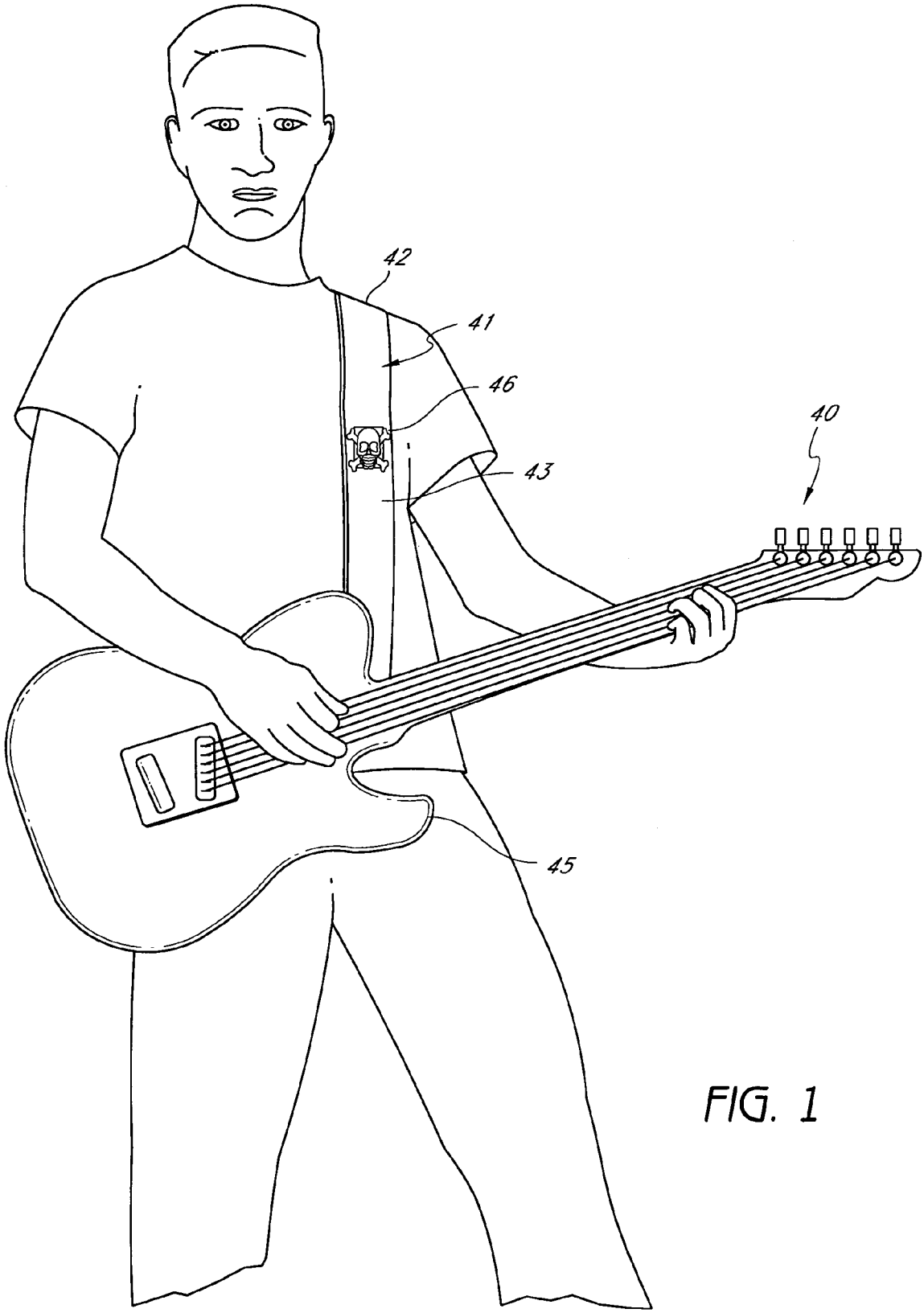
FIG. 1 is an elevational view of a person wearing a strap assembly holding a guitar. The strap assembly has an accessory holding a lighter.

FIG. 1 illustrates a person playing a musical instrument 40. A musical strap assembly 41 is configured to be worn on the body of the person and preferably includes a musical instrument strap 42 that extends about the wearer's body and supports the musical instrument 40, thereby freeing the player's hands for playing the instrument. Generally, the musical instrument strap 42 has ends configured to attach to a musical instrument 40. An accessory 46 in the form of a holder is attached to the musical instrument strap 42 and defines a chamber configured to receive and hold a lighter.

In the illustrated embodiment, the musical instrument 40 is a guitar. However, the musical instrument 40 can be a stringed instrument (e.g., a bass guitar, mandolin, banjo, etc.), a woodwind instrument (e.g., a saxophone), and the like. For the sake of simplicity, the accessories described below are attached to guitar straps. However, the accessories can be attached to other straps, clothing, etc.

The holder 46 can be attached at any point along the musical instrument strap 42. In the illustrated embodiment, the holder 46 is positioned along a portion 43 of the strap 42 and in front of the musician wearing the strap assembly 41. The holder 46 is preferably readily accessible to the musician without moving the guitar 40 from the playing position. As used herein, the term "accessory" is a broad term and is used in its ordinary meaning and may include, without limitation a holder (e.g., a lighter holder, drink container holder, bottle opener holder, etc.), bottle opener, receptacle, etc. Additionally, the accessory can have an eye-catching design that further enhances an audience's viewing pleasure during a performance. The illustrated holder 46 has an eye-catching design in the form of a skull and cross bones. However, the holder 46 can have a design comprising a flag (e.g., American Flag), trademark, advertisement, etc.

Figure 1A:
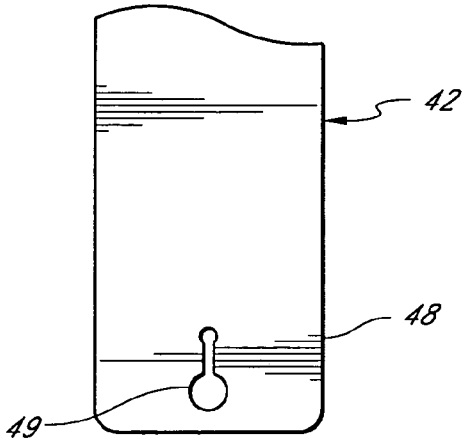
FIG. 1A is an elevational view of one of the ends of a strap assembly.
Figure 1B:
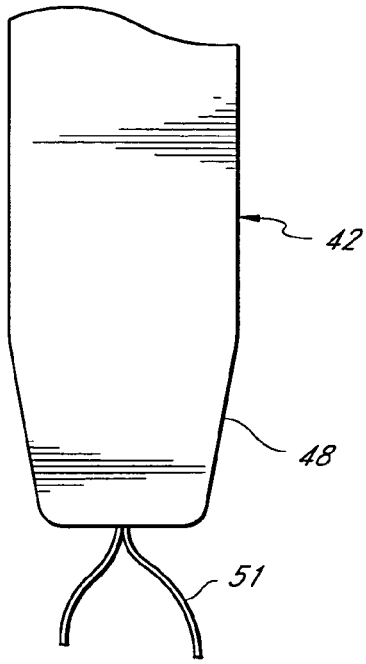
FIG. 1B is an elevational view of one of the ends of a strap assembly in accordance with another embodiment.

In the illustrated embodiment, the strap 42 is a guitar strap configured to attach to and support a guitar. One end of the instrument strap 42 is configured to connect to one side of a body 45 of the guitar 40, and the other end of the strap 42 is configured to connect to an opposing side of the body 45. The guitar instrument strap 42 preferably has a pair of button loops at its ends for securing the strap 42 to attachment structures (e.g., standard button fasteners) found on guitars. FIG. 1A illustrates a first end 48 of the strap 42 that has a button loop 49 configured to mate with a button fastener. The button loop 49 is an aperture suitable for receiving a button fastener on a musical instrument. The button loop 49 may comprise an elongated slot, slit, generally round hole, and/or other design suitable for coupling to an attachment structure of a musical instrument. A skilled artisan can select the design of the strap 42 to attach to different types of guitars, or other musical instruments. As shown in FIG. 1B, for example, the end 48 of the strap 42 can have a tie 51 for tying the strap 42 to a musical instrument. The opposing ends of the strap can have different or similar structures as each other. For example, the strap 42 may comprise the end 48 of FIG. 1A and an opposing end 48 having a plurality of loops 49.

The instrument strap 42 can comprise natural materials (e.g., leather, cotton, and the like), synthetic materials (e.g., polymers such as nylon), and combinations thereof. For example, the strap 42 can comprise leather or leather-like material that conforms to the body of the musician. A skilled artisan can select materials to form the strap 42 to achieve the desired abrasion resistance, tear strength, durability, comfort, and/or other desired properties.

The illustrated strap 42 of FIG. 1 has a one-piece construction. For example, the strap 42 can be a monolithic or unitary strip of material. Alternatively, the strap can be a multi-piece construction and preferably comprises a strip of material connected to couplers configured to attach, e.g., to a musical instrument. The couplers can be formed of plastic, material, metal, and/or the like. The strap 42 can be connected to the coupler by stitching, a buckle arrangement, snap arrangement, or other suitable arrangement.

Figure 1C:
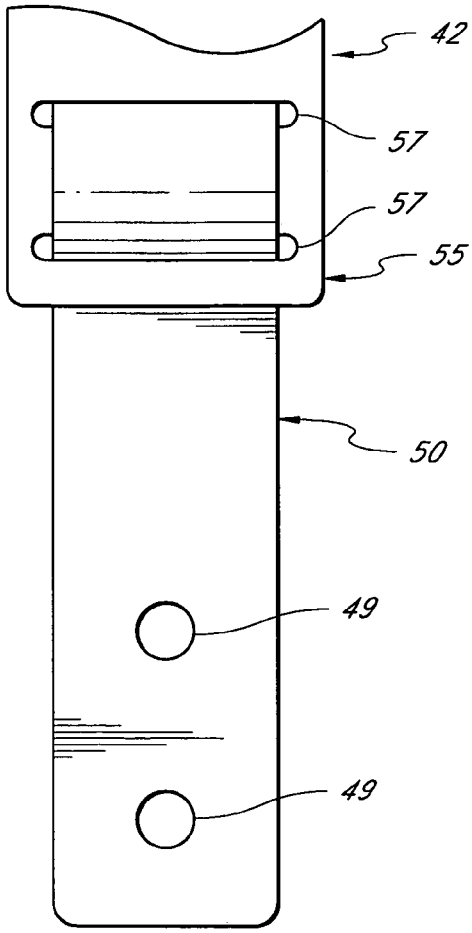
FIG. 1C is an elevational view of one of the ends of a strap assembly in accordance with another embodiment.

Optionally, the strap 42 may include an adjustment means for regulating the length the strap 42. As shown in FIG. 1C, the strap 42 comprises an adjustment system 55 used to selectively regulate the length of the strap 42. The strap 42 comprises a first strap 55 with one or more elongated slots 57 configured to receive a second strap 50.

When the strap assembly 41 is worn, the strap 42 is preferably worn over the musician's shoulder and suspends the guitar 40 in the front of the musician for easy strumming. In some embodiments, the strap 42 can be worn about the neck and above the shoulders of the musician and can have a coupler (e.g., a clip, hook, including a snap hook, and the like) configured to attach to an instrument, such as a saxophone. Of course, the design of the strap can be selected based on the type of instrument attached to the strap. A skilled artisan can select the design of the strap 42 and the means for coupling the strap to a musical instrument.

Figure 2:
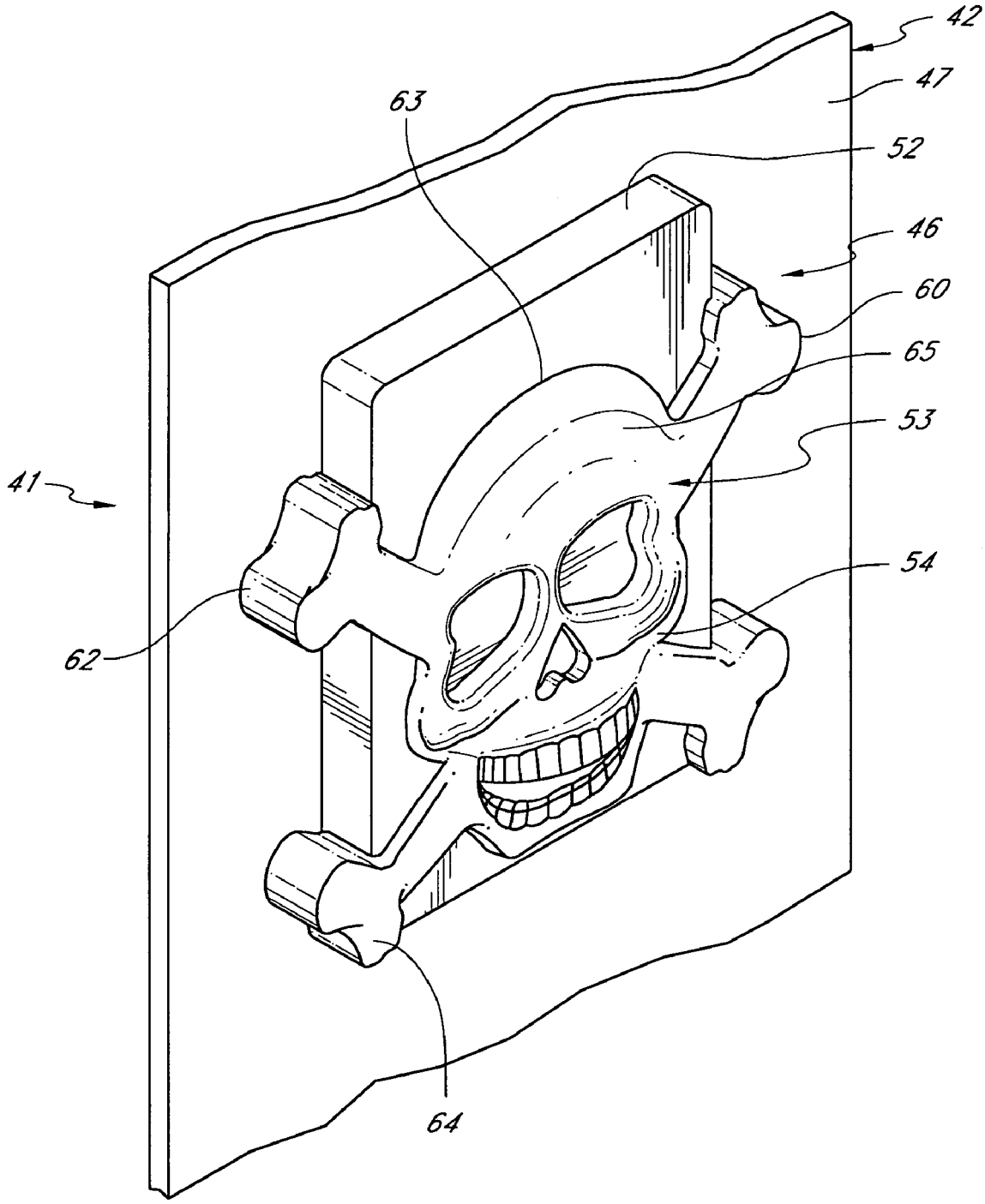
FIG. 2 is an enlarged perspective view of the accessory of the strap assembly of FIG. 1 attached to a strap.

FIG. 2 is a perspective view of the holder 46 attached to the strap 42. The holder 46, alone or in combination with the strap 42, holds the lighter 52. In the illustrated embodiment, the lighter 52 is preferably interposed between the surface 47 of the strap 42 and the holder 46.

The holder 46 comprises a housing 53 that surrounds a portion of the lighter 52, preferably a significant portion of the lighter 52. The housing 53 includes a front portion 54, a first side 60, an opposing second side 62, a bottom 64, and an upper portion 65. In some embodiments, including the illustrated embodiment, a substantial portion of the lighter 52 is disposed within the strap assembly 41.

The front portion 54 is a generally flat body that extends between the first side 60 and the second side 62 and between the bottom 64 and the upper portion 65. The sides 60, 62 extend rearwardly from the front portion 54 and are preferably attached to the strap 42. The first side 60 and the second side 62 cooperate to limit lateral movement of the lighter 52 relative to the holder 46. The first and second sides 60, 62 are generally similar to each other. However, in other embodiments, the first side 60 and second side 62 are different from each other.

Figure 3:
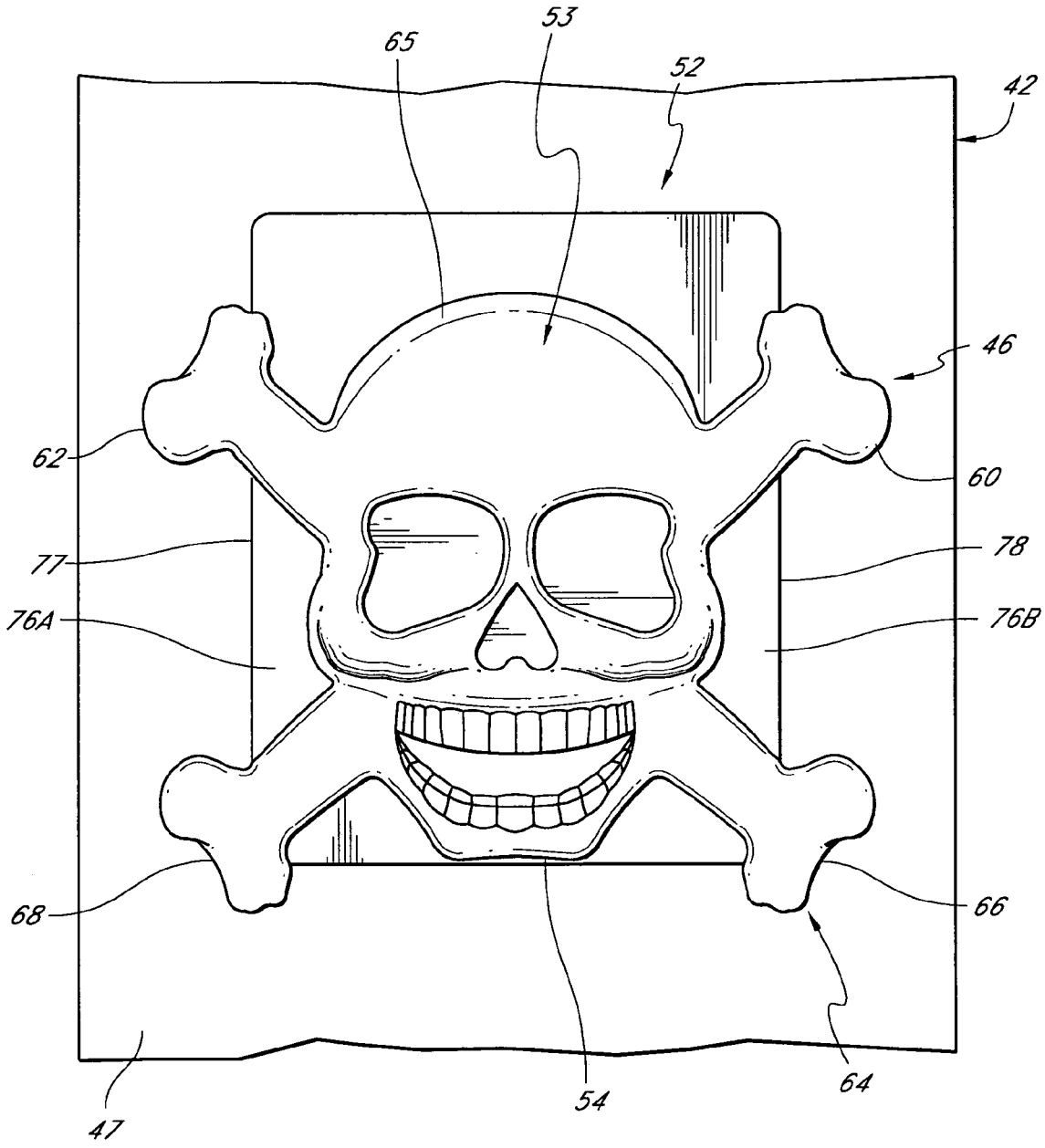
FIG. 3 is a front view of the accessory of the strap assembly of FIG. 2.

With reference to FIG. 3, the bottom 64 of the holder 46 is configured to support the lighter 52. The bottom 64 comprises opposing lower portions 66, 68. The lower portions 66, 68 are configured to hold and support the lower corners of the lighter 52, thereby preventing the downward movement of the lighter 52.

The housing 53 can define an opening 63 (FIGS. 2 and 3B) adapted to permit the lighter 52 to pass therethrough. The opening 63 is preferably defined by the upper portion 53, upper ends of the sides 60, 62, and the strap 42. In the illustrated embodiment, the lighter 52 is disposed within the holder 46 and extends through the opening 63. The opening 63 has a shape that is generally similar to and slightly greater then the cross sectional profile of the lighter 52.

As shown in FIG. 3, the first and second sides 60, 62 can be spaced from the bottom 64 to provide one or more side windows 76A, 76B. A portion of the lighter 52 is exposed by the windows 76A, 76B for convenient access to the lighter 52 in order to move the lighter 52 relative to the holder 46. For example, the wearer of the strap assembly 41 can conveniently grip the sides 77, 78 of the lighter 52 through the windows 76A, 76B and can then slide the lighter 52 into or out of the holder 46. The distance between the sides 60, 62 and the bottom 64 can be selected to achieve the desired size (e.g., length) of the windows. In some non-limiting exemplary embodiments, the first side 60 and the bottom 64 can be configured to define a window 76B having a length equal to or greater than about ¼ inch. In one non-limiting exemplary embodiment, the length of the window 76B is greater than about ½ inch. In another non-limiting exemplary embodiment, the length of the window 76B is greater than about ¾ inch. A skilled artisan can select the desired size of the window 76B to provide the desired access to the lighter 52. The window 76A and window 76B can be generally similar to each other.

Figure 3A:
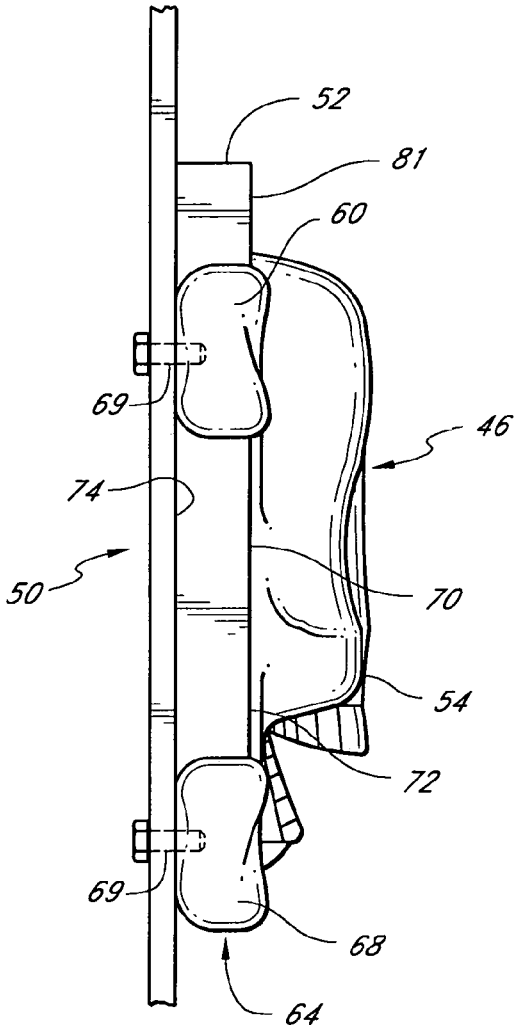
FIG. 3A is a side view of the portion of the strap assembly of FIG. 2, wherein the accessory is holding a lighter.

FIG. 3A is side view of the lighter 52 being held by the holder 46. One or more fasteners couple the holder 46 to the strap 42. The strap 42 is perforated having one or more apertures, each preferably adapted to receive a fastener. A plurality of fasteners 69 preferably extends through the strap 42 and is received within the holder 46. One or more of the first side 60, the second side 62, the lower portion 66, and the lower portion 68 can be coupled to the strap 42 by one or more fasteners 69. In one embodiment, the first side 60, the second side 62, the lower portion 66, and the lower portion 68 each are coupled to the strap 42 by a fastener in the form of a screw.

Figure 3B:
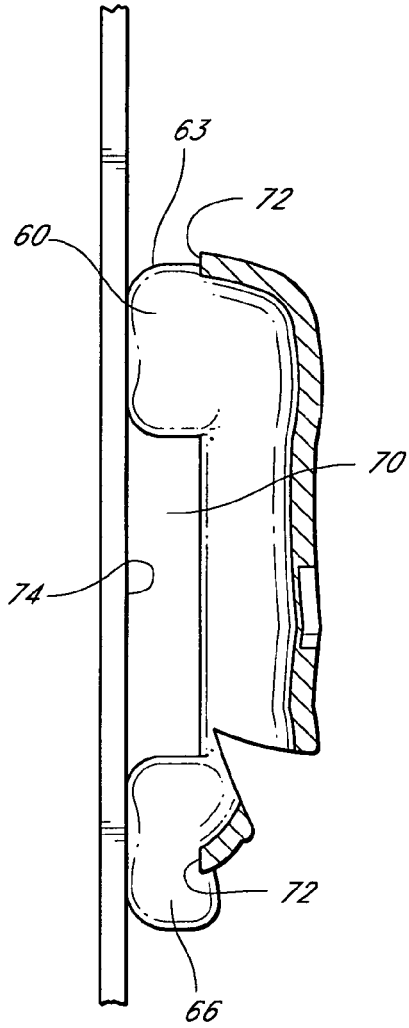
FIG. 3B is a cross-sectional view of the strap assembly of FIG. 4 taken along the line 3B—3B.

With reference to FIGS. 3A and 3B, the assembly 41 has a cavity or chamber 70 configured to receive the lighter 52. The chamber 70 comprises a plurality of walls that defines a chamber generally in the shape of at least a portion of a lighter. In the illustrated embodiment of FIGS. 3B and 5, the cavity 70 is defined by a front cavity surface 72, the pair of side walls 80, 82, the pair of vertical walls 90, 92 and the support surfaces 86, 88.

The front portion 54 defines the front cavity surface 72 configured to engage the outwardly facing surface 81 of the lighter 52. At least a portion of the front cavity surface 72 can be a generally flat surface to reduce frictional interaction with the lighter 52. In some embodiments, the front cavity surface 72 is a generally flat planar body configured to slidably engage the outer surface of the lighter 52. In some embodiments, including the illustrated embodiment of FIG. 3B, the front portion 54 defines a concave surface that has an outer periphery that is generally flat. The surface 47 of the strap 42 preferably defines the back cavity surface 74. The surface 47 and the front surface 72 cooperate to hold the lighter 52 therebetween.

Figure 4:
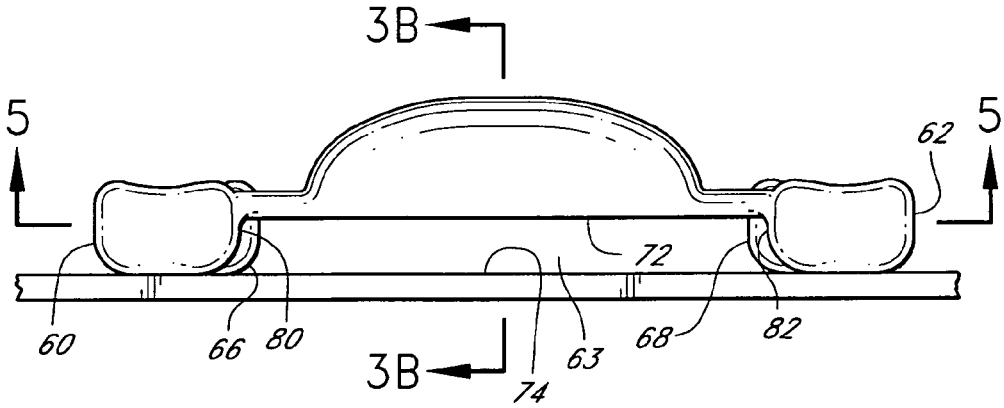
FIG. 4 is a top view of a portion of the strap assembly of FIG. 2, wherein the lighter is removed.
Figure 5:
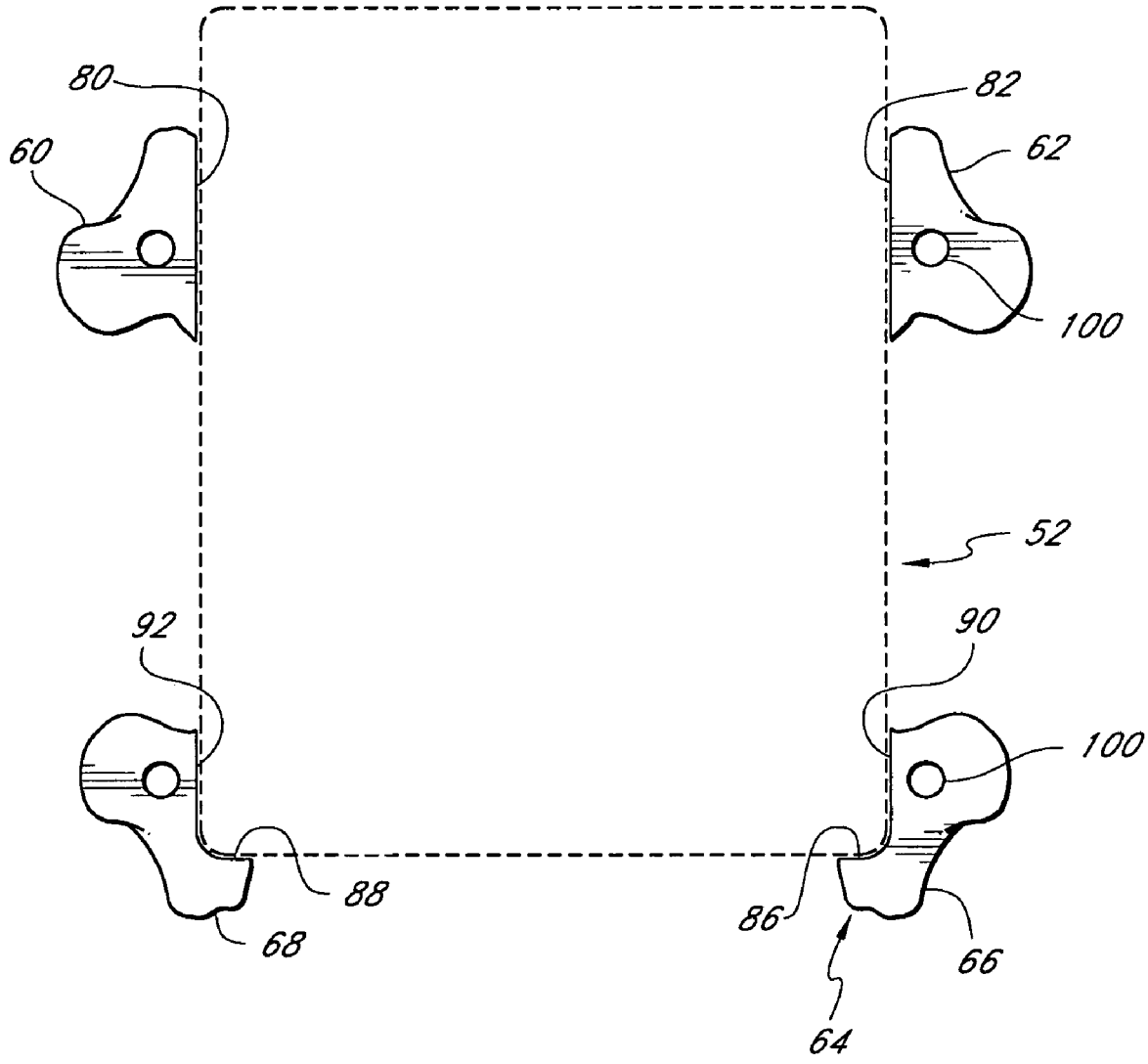
FIG. 5 is a cross-sectional view of the accessory of FIG. 4 taken along the line 5—5.

With respect to FIG. 4, the first side 60 and the second side 62 define the pair of side walls 80, 82, respectively, spaced apart to prevent substantial lateral movement of the lighter 52. The side walls 80, 82 each can define a surface having a similar shape as a portion of the lighter 52. As shown in FIGS. 4 and 5, the side walls 80, 82 can be generally flat in order to mate with the generally flat walls of the lighter 52. However, the side walls 80, 82 can be curved (e.g., convex and/or concave), or have any other shape suitable for mating with a lighter. In some embodiments, the sidewalls 80, 82 are concave in order to mate with a lighter having, e.g., an elliptical cross-section.

One or more of the front cavity surface 72 and the side walls 80, 82 can be generally smooth to reduce frictional interaction between the holder 46 and the lighter 52. Thus, the lighter 52 can be easily slid into and out of the chamber 70. The coefficient of friction of one or more of the cavity surface 72 and side walls 80, 82 can be increased to inhibit or prevent relative movement between the lighter 52 and the holder 46 in at least one direction (e.g., the vertical direction).

The bottom 64 of the holder 46 is configured in some embodiments to support the bottom of the lighter 52 when the lighter 52 rests in the chamber 70. As shown in FIG. 5, the bottom 64 defines one or more support surfaces for holding the lighter 52. Each of the lower portions 66, 68 can have at least one support surface. The support surfaces 86, 88 extend inwardly and are configured to contact and support the lighter 52. Each of the portions 66, 68 can also have vertical side walls 90, 92, respectively. The vertical side walls 90, 92 can capture and prevent substantial lateral movement of the lower end of the lighter 52. In the illustrated embodiment, the vertical side walls 90, 92 are generally perpendicular to the support surfaces 86, 88. However, the vertical side walls 90, 92 and their respective support surfaces 86, 88 can define other angular relationships. For example, the vertical side walls 90, 92 and the corresponding support surfaces 86, 88 can form an angle that is less than or greater than 90 degrees.

The housing 53 can be generally rigid in order to hold and protect the lighter 52. The housing 53 preferably retains its shape when the lighter 52 is place into or removed from the holder 46. The housing 53 can have a one-piece or multi-piece construction. In some embodiments, the housing 53 is a unitary body that is formed through a molding process, machining process, or other suitable manufacturing process. In some embodiments, for example, the housing 53 is monolithically formed through a die-cast molding process. The housing 53 may comprise metal(s) (such as steel, iron, aluminum, brass, metal alloys), plastic, epoxy, composites, combinations thereof, or other suitable materials for holding a lighter. A skilled artisan can select the material to form the housing 53 to achieve the desired structural properties.

FIG. 4 is a top view of the holder 46. The chamber 70 has a cross-sectional profile that is slightly larger than the cross-sectional profile of the lighter 52. The opening 63 defines the upper end of the chamber 70 such that a lighter can be moved into and out of the chamber 70.

The lighter 52 can be a typical lighter used to ignite, e.g., a cigarette or cigar. For example, the lighter 52 can be ZIPPO® lighter that has a width of about 1.5 inches and a length of about 2.125 inches and a thickness of about 0.5 inch. Preferably, in some embodiments the lighter 52 has a generally rectangular, and this can include rounded rectangular, cross-sectional profile. The cross-section of the chamber 70 can be slightly larger than the ZIPPO® lighter so that the ZIPPO® lighter can be easily slid into the chamber 70, and contained therein. In other embodiments, the chamber 70 can have a circular, elliptical, polygonal (including rounded polygonal), and/or other suitable cross-section for receiving a lighter. For example, the cross-section of the chamber 70 can be generally elliptical and configured to receive a BIC® lighter. Thus, the chamber 70 can have various configurations for mating with different types of lighters.

With reference to FIG. 5, the holder 46 can have one or more openings 100 configured to receive fasteners (e.g., the fasteners 69 of FIG. 3A) for coupling the holder 46 to the strap 42. The openings 100 can have internal threads configured to engage external threads of the fasteners 69. The fasteners 69 are threadable coupled to the corresponding openings 100. Alternatively, the fasteners 69 can be rivets, mechanical fasteners (e.g., nut and bolt assemblies), or other couplers for attaching the holder 46 to the strap 42. In yet other embodiments, an adhesive or other means can affix the holder 46 to the strap 42. The holder 46 can be temporarily or permanently coupled to the strap 42.

In operation, to place the lighter 52 into the holder 46, the lower end of the lighter 52 can be inserted into and advanced through the opening 63. The lighter 52 can be moved into the chamber 70 until the lighter 52 contacts the support surfaces 86, 88. After the lighter 52 is positioned in the holder 46, as shown in FIG. 1, the musician can play the guitar without hindrance from the lighter 52 and holder 46.

When the musician wears the strap assembly 41, the chamber 70 can be vertically oriented so that the lighter 52 remains held by the holder 46 before, during, and after the musician plays the musical instrument. Thus, the chamber 70 can have a longitudinal axis that is generally parallel to the longitudinal axis of the instrument strap 42. In some embodiments, the longitudinal axis of the chamber 70 can be at an angular relationship with the strap 42. For example, an angle of less than about 20 degrees can be formed between the longitudinal axis of the chamber 70 and the strap 42. A skilled artisan can select the orientation of the holder 46 and the instrument strap 42 to obtain the desired position and orientation of the holder 46 when the strap assembly 41 is worn.

When a person desires to use the lighter 52, e.g., to light a cigarette, a person can operate the lighter 52 while the lighter remains within the holder 46. The wearer can open the lid of the illustrated lighter 52 and operate the lighter's lighting mechanism to produce fire. Alternatively, the lighter 52 can be removed from the holder 46 before being operated. For example, the wearer can grip and move the lighter 52 out of the holder 46. In the some embodiments, including the illustrated embodiment, the lighter 52 can be slid upwardly out of the holder 46. The wear can grasp the lid of the lighter 52 extending outwardly from the opening 63 or the sides 77, 78 of the lighter 52 during removal. Alternatively, the wear can push upwardly on the bottom of the lighter to slide the lighter 52 upwardly out of the holder 46. After the lighter 52 has been taken out of the holder 46, the lighter 52 can be operated to obtain fire.

The holder 46 can be attached to the strap 42 at various locations. The holder 46 can be attached to the back, front, central portion, ends, etc. of the strap 42. A skilled artisan can select the position of the holder 46 along the strap 42. For example, the holder 46 can be located on the back of the strap 42 to hide and protect the holder 46.

Figure 6A:
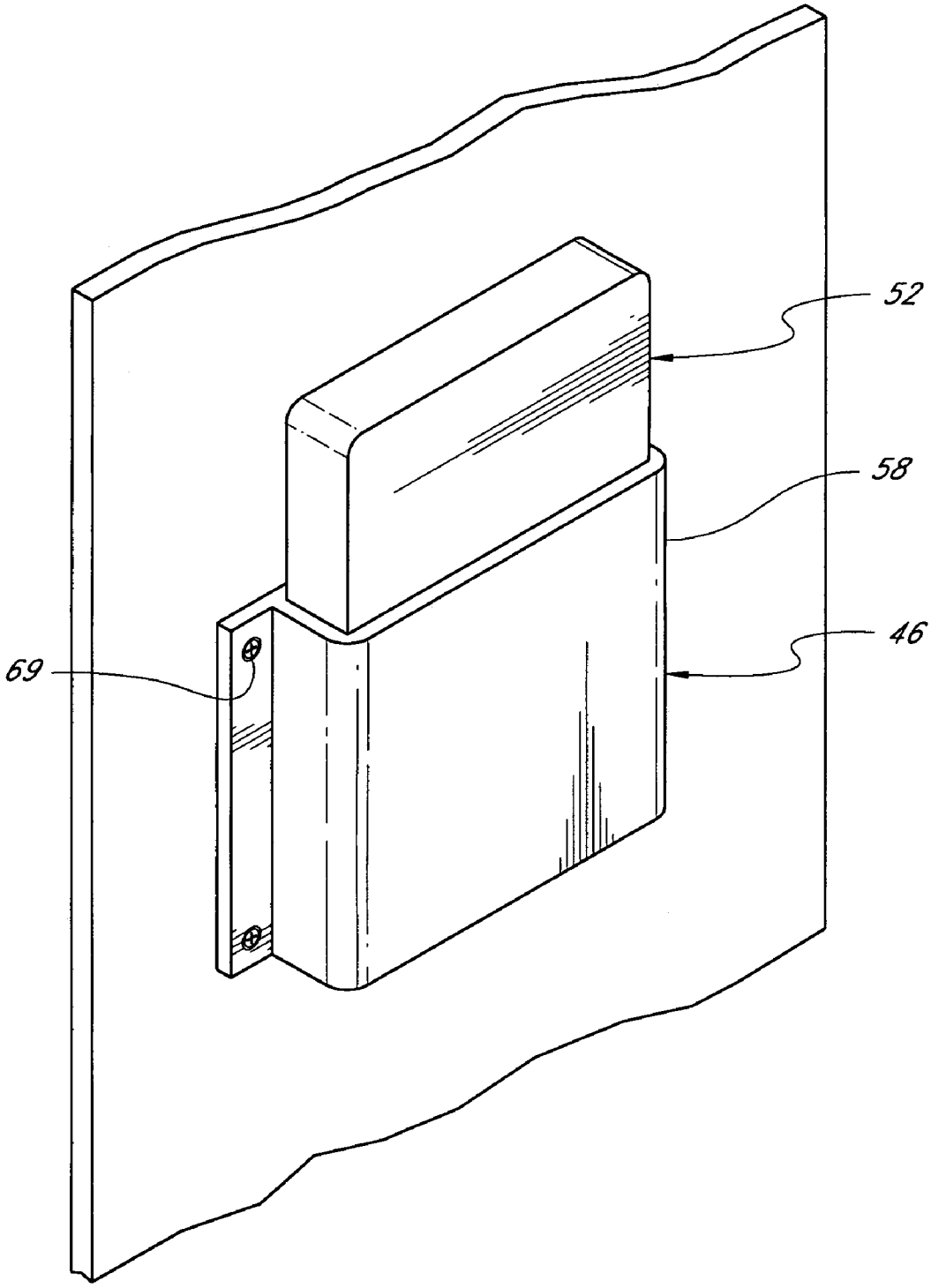
FIG. 6A is a perspective view of a modified strap assembly holding a lighter.

FIG. 6A illustrates a modified embodiment of the holder 46, which may be generally similar to the embodiment illustrated in FIG. 1, except as further detailed below. Where possible, similar elements are identified with identical reference numerals in the depiction of the embodiments of FIGS. 1–5. The holder 46 has a housing 58 that is a sleeve defining a chamber for receiving the lighter 52. The housing 58 may or may not have windows for enabling a person to grip the sides of the lighter. Although not illustrated, the housing 58 can have an eye-catching design for increasing aesthetic appeal of the holder 46.

Figure 6B:
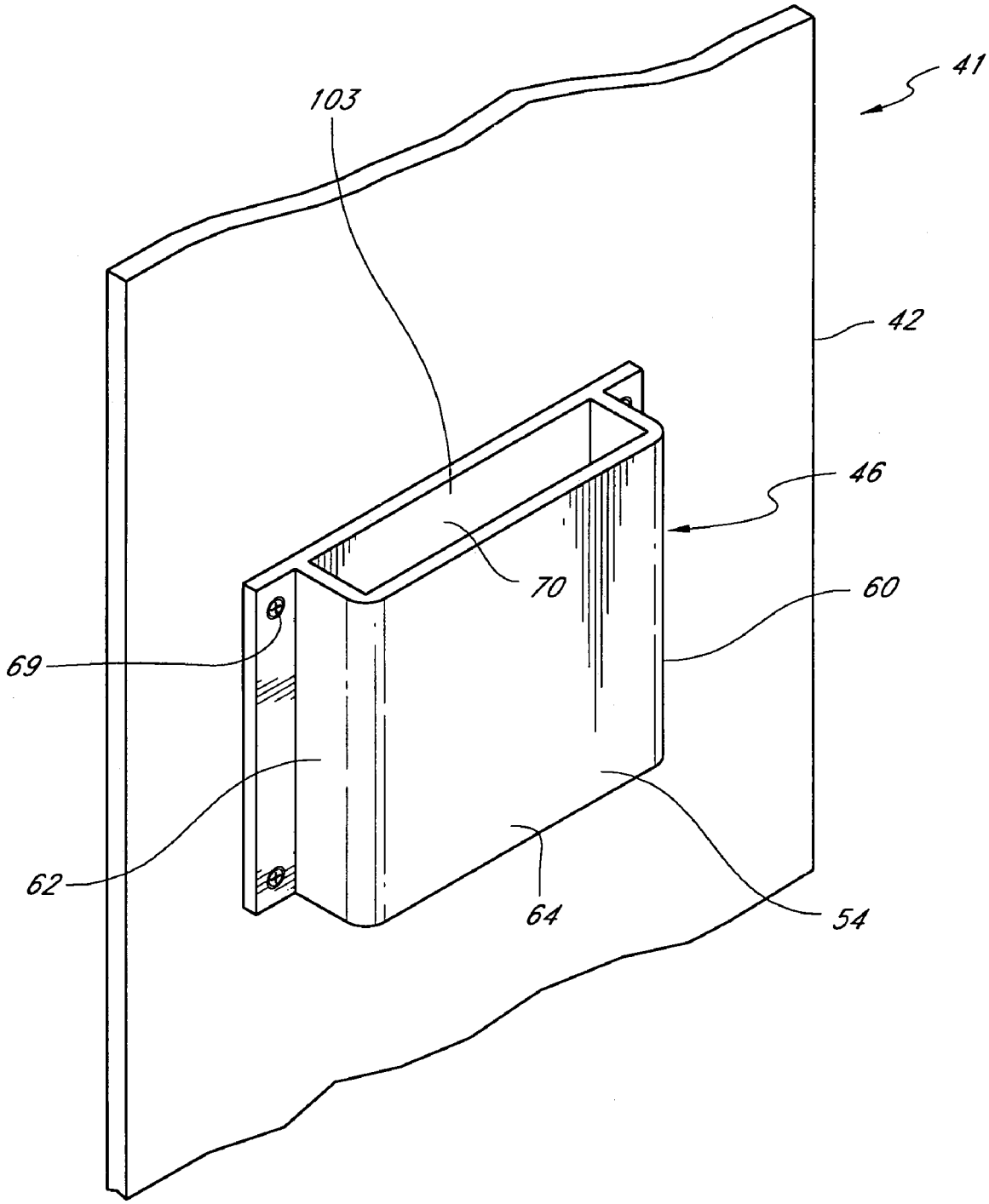
FIG. 6B is a perspective view of the accessory of the strap assembly of FIG. 6A, wherein the lighter is removed.

As shown in FIG. 6B, the holder 46 can have a back wall 103 extending between the sides 60, 62. The lighter 52 can be held by the holder 46 without contacting the strap 42. In other words, the housing 58 can define a chamber 70 that is spaced from the strap 42.

In some embodiments, the holder 46 is temporarily coupled to the guitar instrument strap 42. For example, the fasteners 69 can be hook-and-loop-type coupler(s) (e.g., VELCRO®). The strap 42 can have one of the hook or loop portions and the holder 46 can have the other of the hook or loop portions. Alternatively, the fasteners 69 can be snaps or other structures suitable for temporarily coupling the holder 46 to the strap 42. Advantageously, accessories of different designs can be interchanged and coupled to the strap 42. Of course, in other embodiments, the holder 46 is permanently coupled to the strap 42 by, e.g., rivets.

In some embodiments, the strap assembly 41 is configured to hold other types of articles. For example, the article 52 can be in the form of a container, such as a flask, for holding a fluid. The container 52 can have a similar or different shape as the lighter 52 described above. For example, the strap assembly 41 can have a chamber 70 with a generally rectangular profile, circular profile, or other shape for receiving and holding the drink container. A skilled artisan can select the design of the chamber 70 of the strap assembly 41 to hold different types of containers.

The strap assembly 41 can be configured to hold one or more tools, preferably tools used on a musical instrument attached to the strap assembly 41. The holder 46 can have a chamber 70 that holds one or more Allen wrenches, string cutters, or other equipment. For example, a plurality of Allen wrenches can be disposed within the holder 46. The upper ends of the Allen wrenches can extend out of the holder 46 for conveniently gripping and removing of the wrenches. As such, the wrenches can be stored in the holder 46 and easily removed and returned to the holder 46. Optionally, the holder 46 can have a means for inhibiting or preventing movement of the tools held by the holder 46. The holder 46 can have one or more magnets, straps, slots, holes, and/or other suitable structures for engaging tools. For example, the holder 46 can have magnets that generate a magnetic field to hold tools securely within the holder 46. The holder 46 can have one or more magnets spaced about the periphery of the chamber 70 to engage items held within the chamber 70. In some embodiments, the holder 46 has a wall, such as the back or front wall, that is magnetized in order to securely hold items.

Figure 6C:
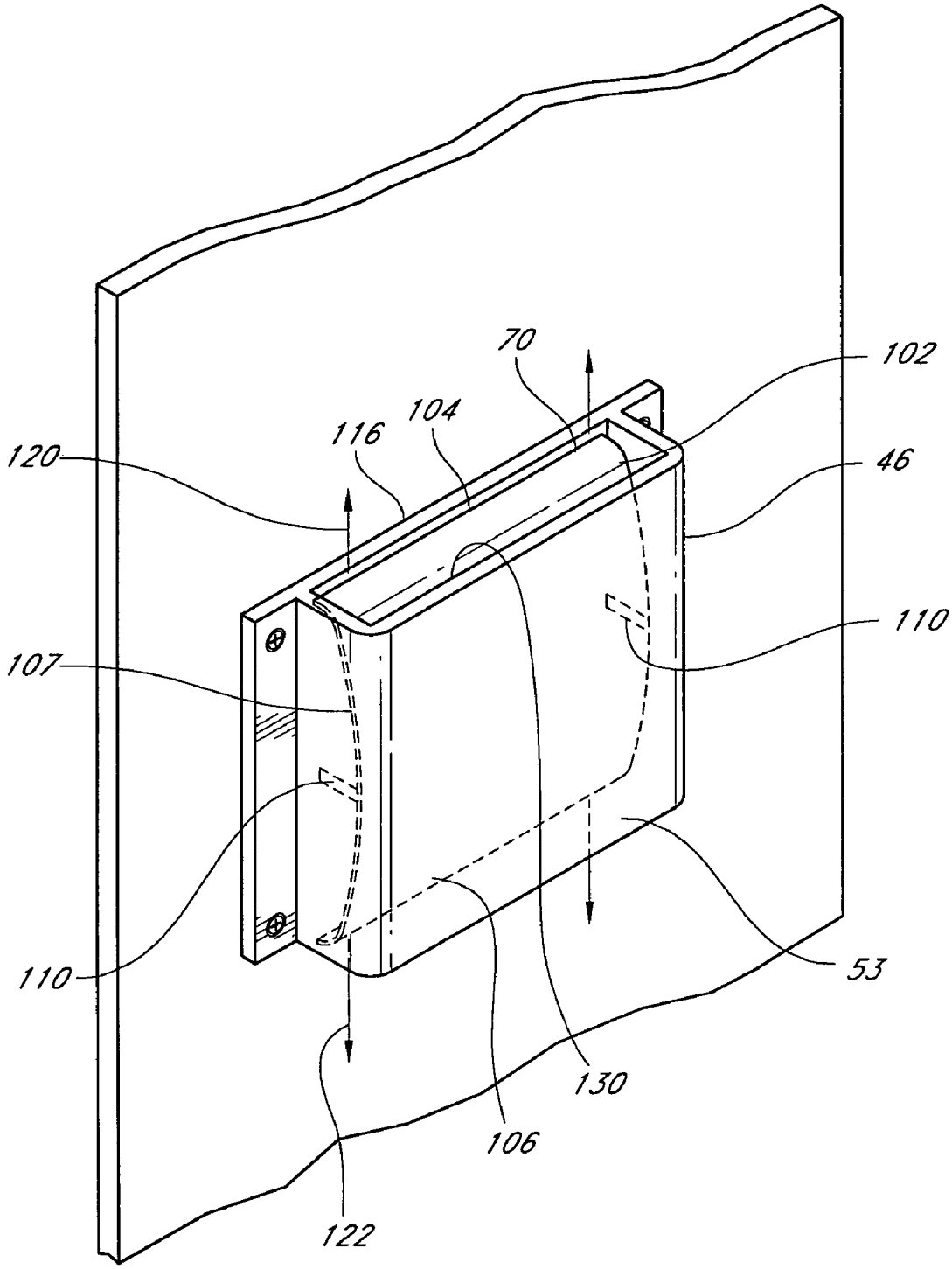
FIG. 6C is a perspective view of an accessory of a strap assembly, the accessory having an adjustable chamber.

FIG. 6C illustrates a modified embodiment of the holder 46. The holder 46 includes a chamber 70 that is adjustable to accommodate articles of different sizes. The holder 46 comprises a member 102 that is moveable relative to the housing 53 and can have a first position when the holder 46 is empty and a second position when the holder 46 holds one or more articles, such as a lighter, cosmetics (e.g., lipstick), guitar slide, tools, drinkware opener other articles disclosed herein, and the like. The articles can be removed from and returned to the holder 46. For example, a bottle opener can be held by the holder 46. A person can remove from the holder 46 and then use the bottle opener. The bottle opener can then be returned to the holder 46.

The member 102 can preferably apply a pressure to the article to inhibit or prevent the movement of the article relative to the holder 46. Thus, the holder 46 can securely hold an article, thereby reducing the likelihood that the article will slide out of the holder 46. For the sake of simplicity, the holder 46 is described primarily with respect holding a lighter. However, the holder 46 can be configured to hold any of the other articles disclosed herein.

The member 102 is configured to frictionally engage a lighter (e.g., the lighter 52) positioned within the chamber 70. The member 102 is preferably biased to apply a force in the outward direction, i.e., away from the back wall 116 in order to apply a pressure to the lighter 52 held by the holder 46. The member 102 can be a thin sheet of metal, plastic, or other suitable material for applying pressure to an article.

The member 102 includes an upper end 104, lower end 106, and body 107 therebetween. The upper end 104 and lower end 106 can move relative to housing 53 to change the dimensions of the chamber 70. The body 107 is curved inwardly into the chamber 70, such that at least a portion of the body 107 contacts a lighter 52 inserted into the chamber 70.

One or more couplers 110 can couple the member 102 to the back wall 116 of the holder 46. The one or more couplers 110 can be attached at any suitable point along the member 102. The couplers 110 can be attached to the back wall 116 and to one side of the member 102. The coupler 110 can be formed of plastic, rubber, or the like.

When a lighter 52 is inserted and advance into a chamber 70, the lighter 52 can press the member 102 towards the back wall 116. As the member 102 moves toward the back wall 116, the upper end 104 and lower end 106 can move in the direction indicated by the arrow 120, 122, respectively. In this manner, the member 102 can be moved toward the back wall 116 as the lighter 52 is advanced into the chamber 70. Once the lighter 52 is fully inserted into the holder 46, the member 102 can contact the back wall 116, or can be spaced therefrom. When the lighter 52 is held by the holder 46, the member 102 can apply a pressure to the back surface of the lighter thereby frictionally holding the lighter 52. As the lighter 52 is moved upwardly out of the holder 46, the central portion of the member 102 can move away from the back wall 116 and the ends 104, 106 can move toward each other until the lighter 52 is removed from the holder 46.

In other embodiments, the member 102 can have curved portions and/or flat portions. Optionally, the end 104 of the member 102 can be curved toward the nearest wall of the housing 53 of the holder 46. The coupler 110 can be in the form of one or more springs that couples the member 102 to at least one of the walls of the holder 46. The springs 110 can bias the member 102 towards the opposing wall to define a chamber 70 that is moveable to accommodate an article disposed within the holder 46.

Figure 6D:
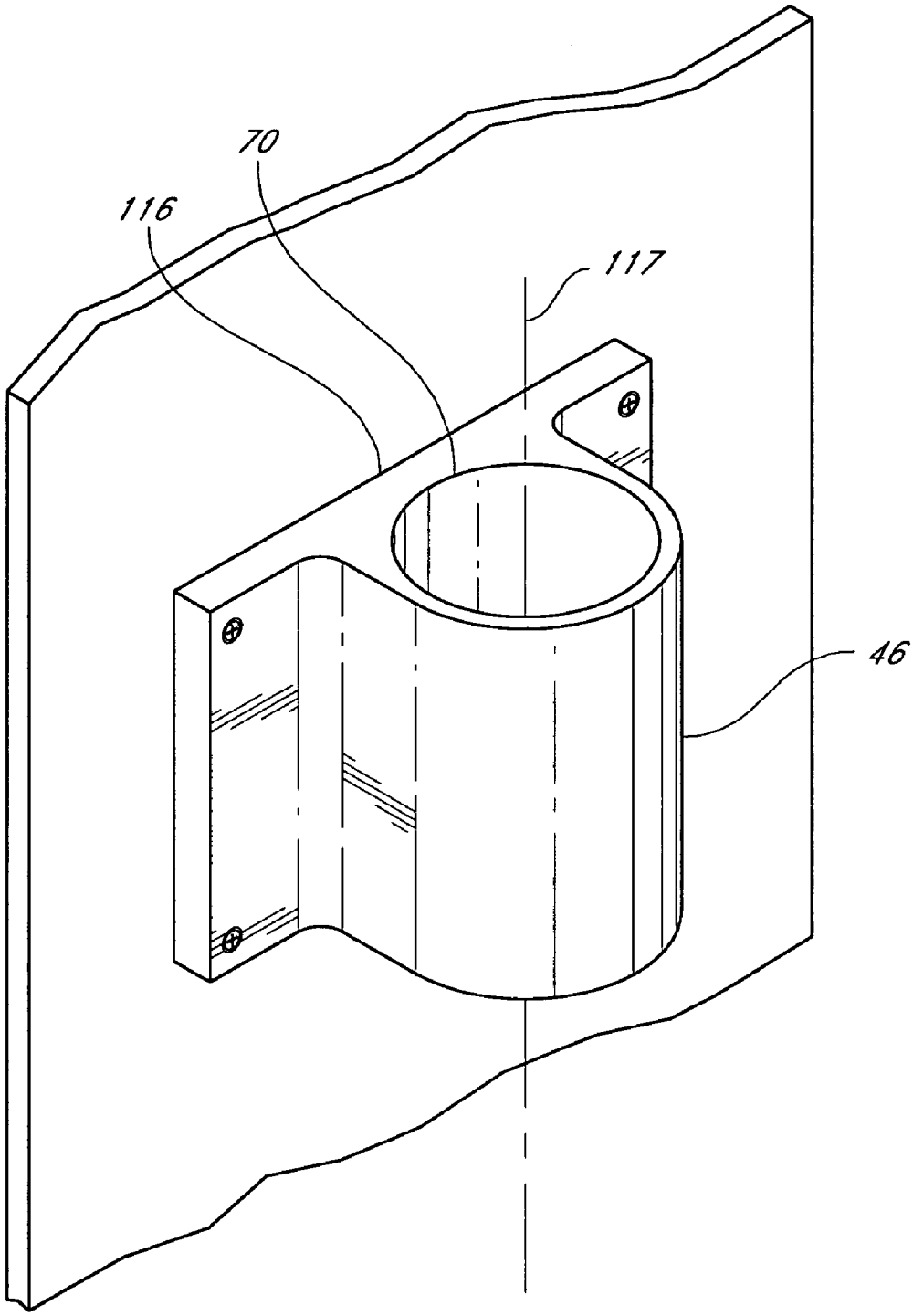
FIG. 6D is a perspective view of an accessory of a strap assembly, the accessory in accordance with another embodiment.

FIG. 6D depicts a holder 46 that defines a chamber 70 suitable for holding one or more articles, such as guitar slides, lipstick containers, cosmetic containers, drinking containers, and/or the like. The chamber 70 can have an elliptical, circular, rounded polygonal, or other cross sectional profiles.

Preferably, a substantial portion of the article is disposed in the chamber 70 when the article is fully inserted into the holder 46. In some non-limiting exemplary embodiments, the chamber 70 is sized such that at least 60% of the article can be disposed within the chamber 70. In some non-limiting exemplary embodiments, the chamber 70 is sized such that at least 70% to 90% of the article is disposed within the chamber 70. In some non-limiting exemplary embodiments, the chamber 70 is sized to receive the entire article, preferably such that the article does not extend out of the holder 46.

The cross-section of the chamber 70 is preferably at least slightly larger than the cross-section of the article held therein. In some embodiments, the chamber 70 has a cross-sectional area that is generally constant along the longitudinal axis of the chamber 70. However, the chamber 70 can have a cross-sectional area that varies along the longitudinal axis of the chamber 70.

In some non-limiting exemplary embodiments, the chamber 70 is configured to hold one or more slides (e.g., guitar slides) and has a cross-sectional area (i.e., the area of the chamber 70 in a plane generally orthogonal to the longitudinal axis 117 of the holder 46) of about 0.35 $in^2$, 0.50 $in^2$, 0.60 $in^2$, 0.70 $in^2$, 0.80 $in^2$, and ranges encompassing such areas. The cross-sectional area of the chamber 70 can be generally circular, elliptical or have any other shape suitable for holding a guitar slide. In some embodiments, the cross-sectional area of the chamber 70 taken along the longitudinal axis 117 is in the range of about 1 $in^2$ to 3.5 $in^2$, more preferably in the range of about range of about 1.5 $in^2$ to about 3 $in^2$. The chamber 70 has a length along its longitudinal axis in the range of about 1.5 in to 3 in.

In some embodiments, the chamber 70 is configured to hold a one or more cosmetic containers (e.g., lipstick containers) and has a cross-sectional area (i.e., the area of the chamber 70 in a plane generally orthogonal to the longitudinal axis 117 of the holder 46) of about 0.50 $in^2$, 0.75 $in^2$, 1 $in^2$, 1.5 $in^2$, 2 $in^2$, 2.5 $in^2$ and range encompassing such areas. In some embodiments, the chamber 70 is generally circular, polygonal (including rounded polygonal such as a rounded square). The chamber 70 has a length along its longitudinal axis 117 that is greater than about 0.5 inches. In some embodiments, the chamber 70 has a length along its longitudinal axis 117 that is less than about 3 inches, including 2.5 inches and 1.5 inches.

In some embodiments, the chamber 70 is configured to hold one or more drink containers and has a cross-sectional area of about 1 $in^2$, 3 $in^2$, 5 $in^2$, and ranges encompassing such areas. The cross-sectional area of the chamber 70 can be substantially circular, elliptical, polygonal (included rounded polygonal), and other shapes suitable for holding known drink containers. In some embodiments, the chamber 70 has a length along its longitudinal axis 117 that is more than about 1.5 inches. In some embodiments, the chamber 70 has a length along its longitudinal axis 117 that is less than about 6 inches.

Figure 6E:
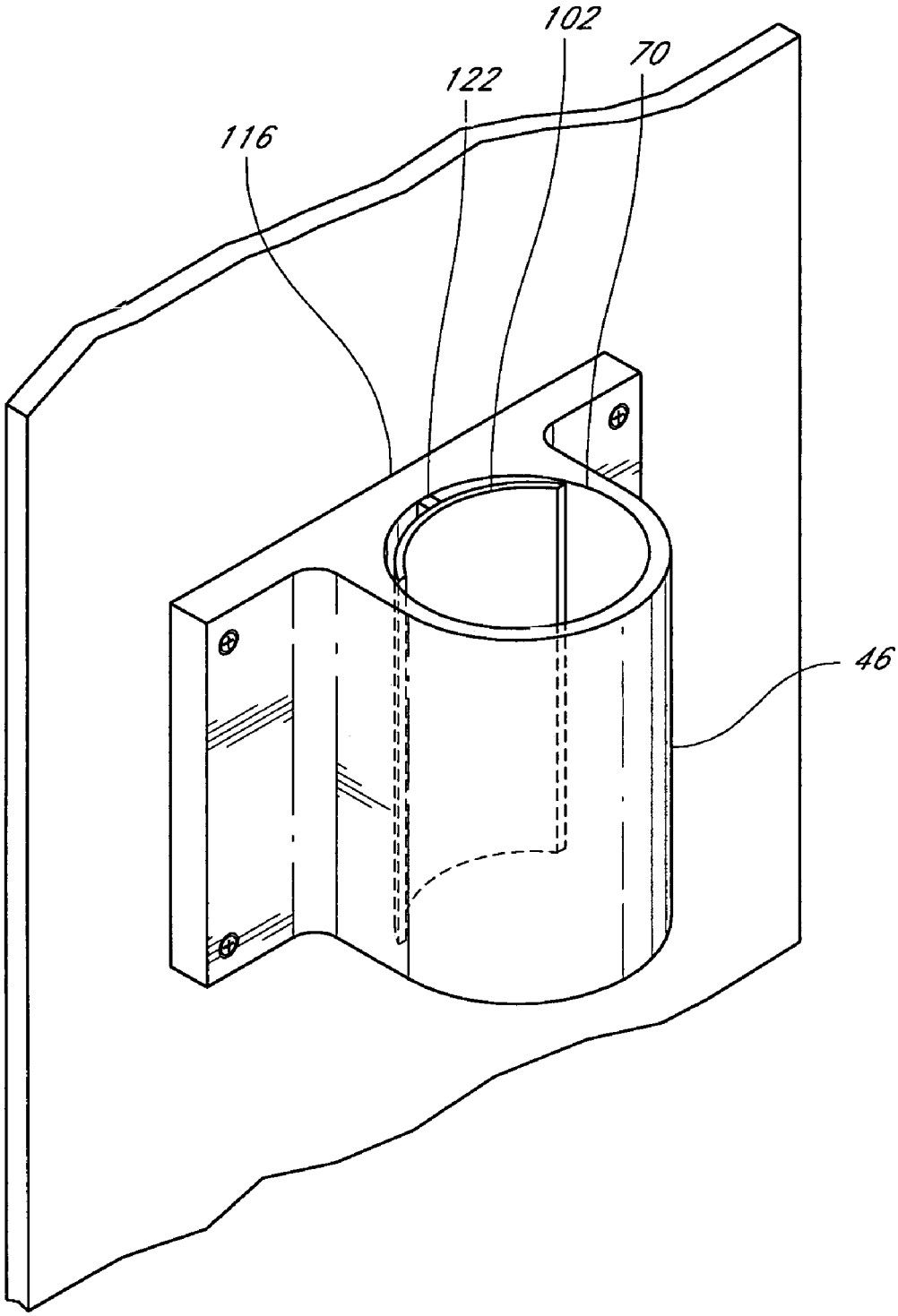
FIG. 6E is a perspective view of an accessory of a strap assembly, the accessory in having an adjustable chamber.

With reference to FIG. 6E, the holder 46 includes a member 102 configured to engage a curved surface. In the illustrated embodiment, the member 102 has a shape that is generally similar to the back wall 116. However, in other embodiments the member 102 can have a shape that is generally similar to other portions of the holder 46.

Optionally, the holder 46 can also comprise a coupler 122 (e.g., a spring) that couples the member 102 to the housing 53. In some embodiments a plurality of springs 122 couples the member 102 to the back wall 116. The member 102 can therefore be moved towards or away from the back wall 116 to accommodate various sized articles, such as guitar slides, cosmetics (e.g., lipstick), a flask, or other item(s). Thus, the member 102 can cooperate with the walls of the holder 46 to tightly hold an article within the chamber 70.

Although not illustrated, the member 102 can be attached to the front wall or side walls of the holder 46. Additionally, a plurality of members 102 can be disposed within the chamber 70. For example, the back wall 116 and the front wall can each have a member 102 configured to apply an inwardly directed force that holds a lighter within the holder 46. In another exemplary embodiment, a plurality of members 102 is attached to one of the walls of the housing 53.

Figure 6F:
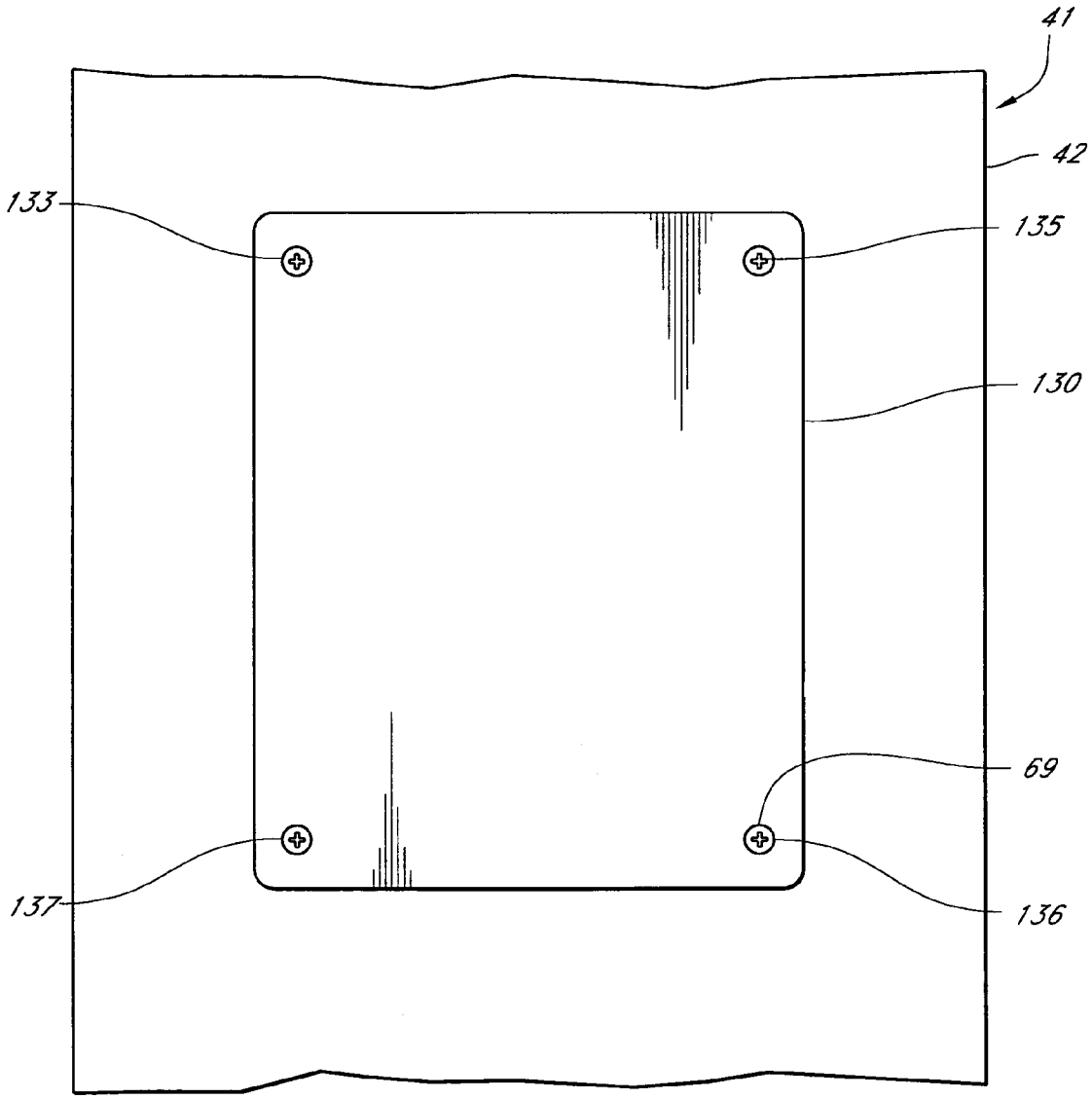
FIG. 6F is a back view of a strap assembly having a support plate.

FIG. 6F illustrates the back of the strap assembly 41. The strap assembly 41 can optionally comprise a support 130 for providing structural support to the assembly 41. The support 130 can be a stiffener designed to reinforce and provide structural support to the strap 42.

The support 130 includes one or more mounting structures for attaching to the strap 42. The illustrated support 130 includes a plurality of holes 133, 135, 136, 137 adapted to receive a corresponding fastener 69, which in turn extends through the strap 42 and into the accessory. The holes of the support 130 preferably correspond to holes formed in the accessory and in the strap 42. Any suitable number of fasteners 69 can be used to couple the support 130 to the strap 42. In other embodiments, the strap assembly has two or more fasteners attaching the accessory to the strap 42. The illustrated strap assembly 41 has four fasteners for attaching the accessory to the strap 42. A skilled artisan can select the appropriate number of fasteners to attach the accessory and support 130 to the strap 42.

The support 130 is a generally flat-plate that comprises a somewhat ridged material (e.g., metal, plastic, composite, combinations thereof, and the like) suitable for supporting the accessory, such as the accessory 46. The support plate 130 can have a generally polygonal (including rounded polygonal), circular, elliptical, or other shape suitable for providing structural support to the strap assembly 41.

Optionally, the support plate 130 preferably defines a surface area that is generally equal to or greater than the surface area of the face of the accessory facing the strap 42. Preferably, the support plate 130 is generally stiffer than the strap 42. The thickness of the support plate 130 can be increased or decreased to decrease or increase the flexure of the support 130 when the accessory holds an item, is used to open drinkware, and the like.

FIGS. 7–11 depict other embodiments of the strap assembly 41, which may be generally similar to the embodiments illustrated in FIGS. 1–6B, except as further detailed below. Where possible, similar elements are identified with identical reference numerals in the depiction of the embodiments of FIGS. 1–6B.

Figure 7:
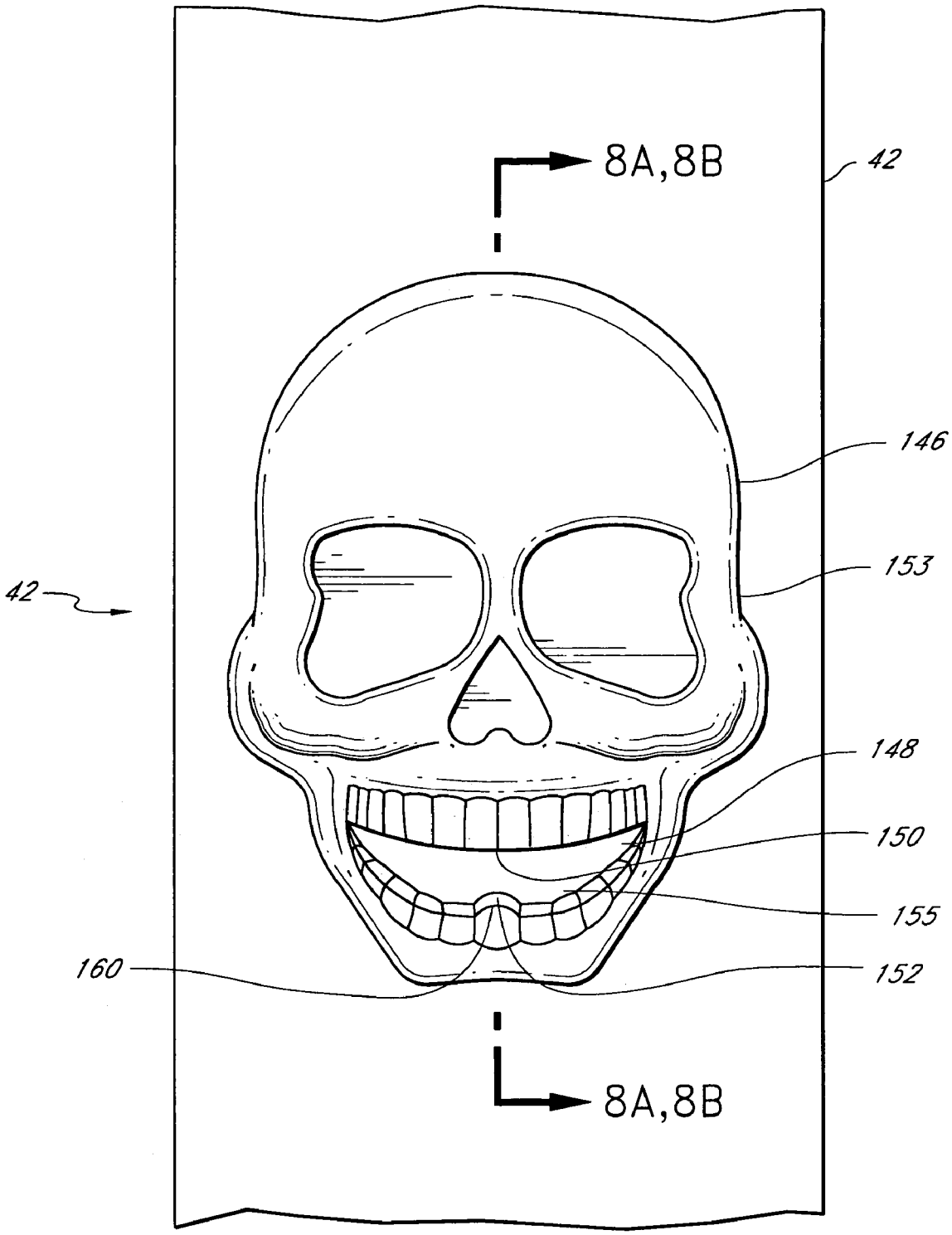
FIG. 7 is a front view of a strap assembly having an accessory in accordance with another embodiment.

FIG. 7 illustrates a strap assembly 41 that comprises an accessory 146 adapted to open drinkware by removing a closure. The drinkware can be a container for containing foodstuffs, such as ingestible liquid (e.g., beverages including alcoholic and carbonated liquids, water, coffee, and the like). As used herein, the term "drinkware" is a broad term and is used in its ordinary meaning and includes, without limitation, drink containers, bottles, cans, or the like. The drinkware can comprise glass, plastic, foam, and/or metal and is preferably configured to be closed with a closure.

As used herein, the term "closure" is a broad term and is used in its ordinary meaning and includes, without limitation, a crown closure, bottle cap, snap cap, punctured seal, cork or plug, or the like suitable for closing drinkware. The terms "closure" and "cap" may be used interchangeably herein. Generally, the accessory 146 can be used to open or remove a closure in order to consume foodstuff within drinkware. Preferably, the accessory 146 is a bottle opener that can grasp at least a portion of a closure to pull the closure from the container as the container is moved relative to the bottle opener 146.

With continued reference to FIG. 7, the bottle opener 146 comprises a housing 153 that is attached to the strap 42 and a receiving window 148 adapted to receive a portion of a closure. In some embodiments, the receiving window 148 is configured to receive a typical bottle cap that is attached bottle used to hold beverage (e.g., soda, alcoholic beverage, etc.). The receiving window 148 can be defined by a first edge 150 and a second edge 152 of the housing 153. The first edge 150 and the second edge 152 each comprise an arcuate segment, wherein a portion of the edges 150, 152 are capable engaging a closure.

Figure 8A:
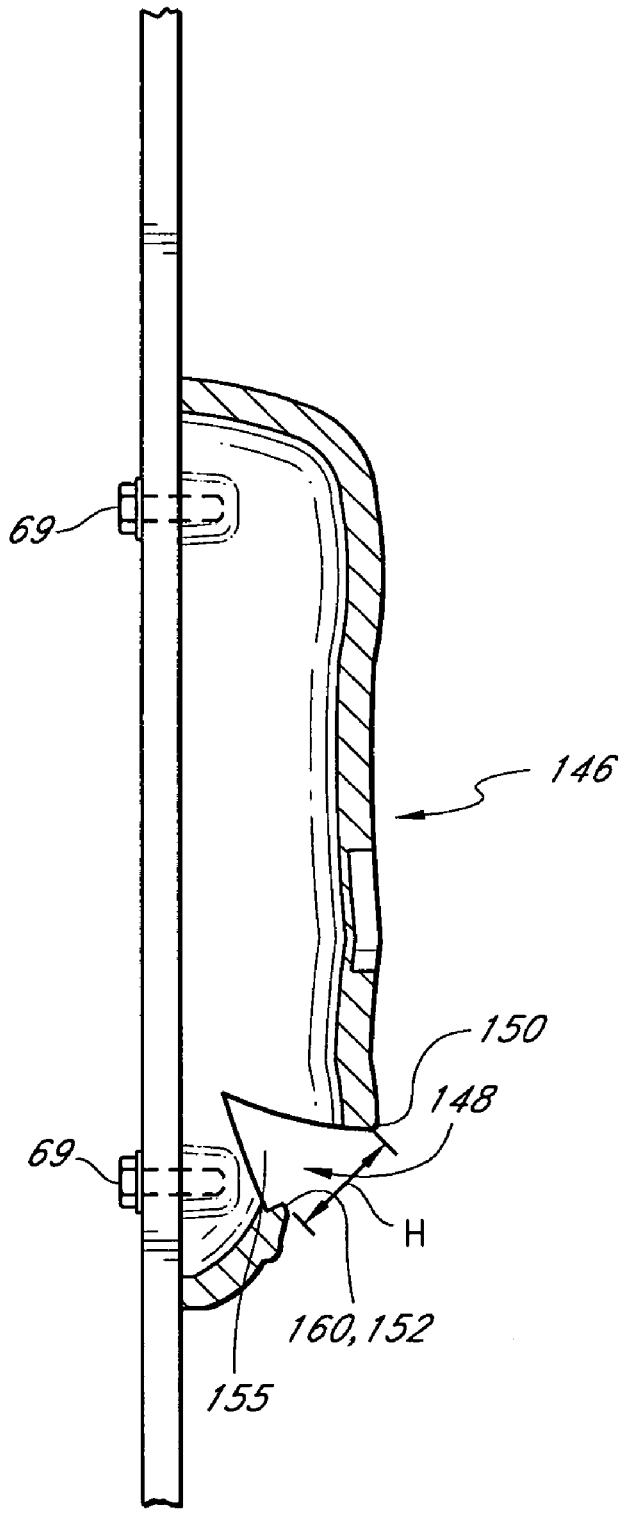
FIG. 8A is a cross-sectional view of the accessory of FIG. 7 taken along the line 8A—8A.

With respect to FIG. 8A, the receiving window 148 has a height H less than about 0.5 inches. In some embodiments, the height H is in the range of about 0.25 inch to about 0.75 inch, including about 0.375 inch, 0.5 inch, 0.625 inch and ranges encompassing such heights. These heights H provides a window that can receive a portion of a closure appropriate for prying the closure from a container while the bottle opener 146 is attached to the strap 42.

Figure 8B:
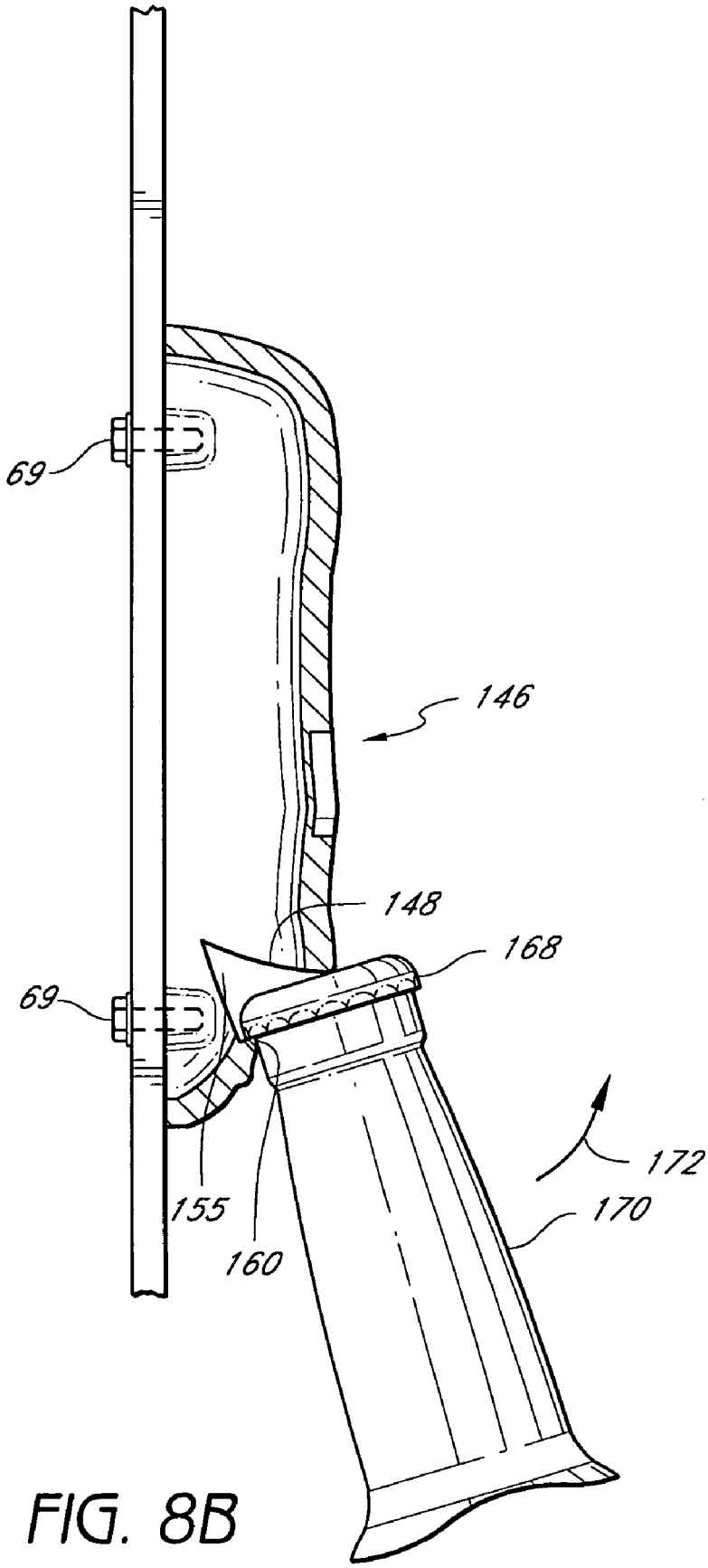
FIG. 8B is a cross-sectional view of the accessory of FIG. 7 taken along the line 8B-8B, the accessory is gripping a bottle cap on a bottle.

The housing 153 defines a recessed region 155 that extends rearwardly from the window 148. The recessed region 155 is preferably configured and sized to receive at least a portion of a closure passed through the receiving window 148. As shown in FIG. 8B, a closure 168 in the form of a bottle cap is attached to a container 170 and extends through the window 148 and is received within the recessed region 155. The container 170 can be moved relative to the bottle opener 146 to remove the closure 168 from the container.

Optionally, the second edge 152 comprises a protrusion or tab 160. As illustrated in FIGS. 7 to 8B, the protrusion 160 can extend outwardly from the second edge 152. When the container 170 is in the illustrated position of FIG. 8B, the protrusion 160 can be positioned between the lip of the closure 168 and the container 170. In other words, the protrusion 160 can be inserted between the closure 168 and the top of the container 170. After the bottle opener 146 grips the closure 168 in this manner, the container 170 can be moved relative to the bottle opener 146 to remove the closure 168 from the container 170. It is contemplated that one or more protrusions 160 can be at any point along the first edge 150 and/or second edge 152. Alternatively, the second edge 152 can be a generally smooth continuous edge that is configured to engage and remove the closure 168.

In operation, the closure 168 is positioned within the window 148 of the bottle opener 146 such that the first edge 150 and second edge 152 engaged the closure 168. After the closure 168 is grasped between the first edge 150 and the second edge 152, the container 170 can be moved relative to the bottle opener 146 to pry off the closure 168. In some embodiments, including the illustrated embodiment, the container 170 can be rotated in the direction indicated by the arrow 172 such that the protrusion 160 applies a force to a portion of the lip of the closure 168 while the first edge 150 applies a force to a central portion of the closure 168. As the container 170 is rotated, the closure 168 is held within the receiving window 148 until the closure 168 is completely separated from the container 170. Preferably, the bottle opener 146 can be used to open a container while the strap 42 is being worn. Thus, the musician can wear the strap 42, which supports a guitar while the bottle opener 146 is used to open the container 170. Of course, there are other ways of employing the bottle opener 146 to remove the closure 168. For example, after the closure 168 is gripped by the accessory 146, the container 170 can be moved in an outwardly direction (i.e., the direction normal to the strap 42) to pull off the closure 168.

The individual wearing the strap assembly 41 can advantageously quickly and easily use the bottle opener 146 to open drinkware while wearing the strap assembly 41 and musical instrument. The bottle opener 146 can also be used by a person not wearing the strap assembly 41 to open a container. For example, the musician wearing the strap assembly 41 can continue to play the musical instrument supported by the assembly 41 while another person uses the bottle opener 146 to open drinkware.

Although not illustrated, the accessory can have a slot or opening that is suitable for gripping and removing a closure from a container. For example, a modified bottle opener 146 can have an opening 148 that has a circular or curved portion and a portion that is somewhat straight. The straight portion of the opening 148 can be used to remove a closure, such as a bottle cap, after the bottle cap is positioned within the opening 148. The accessory can also have known configurations suitable for removing a closure from drink container.

Figure 8C:
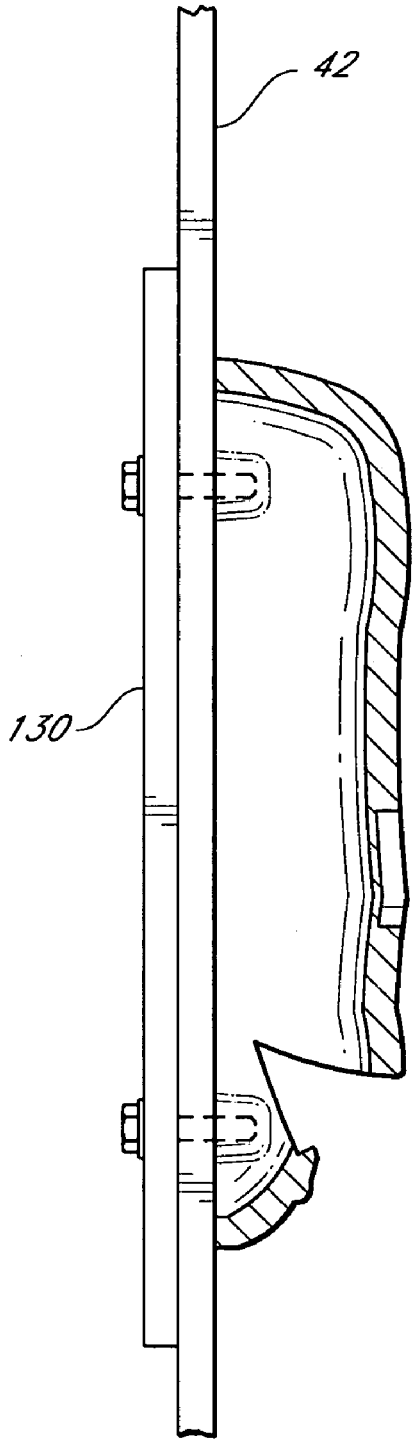
FIG. 8C is a modified strap assembly of FIG. 8A, the strap assembly having a support plate.

FIG. 8C illustrates a modified embodiment of the strap assembly. The support 130 is positioned between the heads of the fasteners 69 and the strap 42. Thus, the strap 42 is interposed between the support 42 and the accessory 146. The support 130 can advantageously reduce or prevent tearing or bending of the strap 42 located between the accessory 146 and the support 130. A skilled artisan can select the thickness and dimensions of the support 130, the materials forming the support 130, and the location of the fasteners 69 to achieve the desired structural support to the accessory 146.

Figure 9:
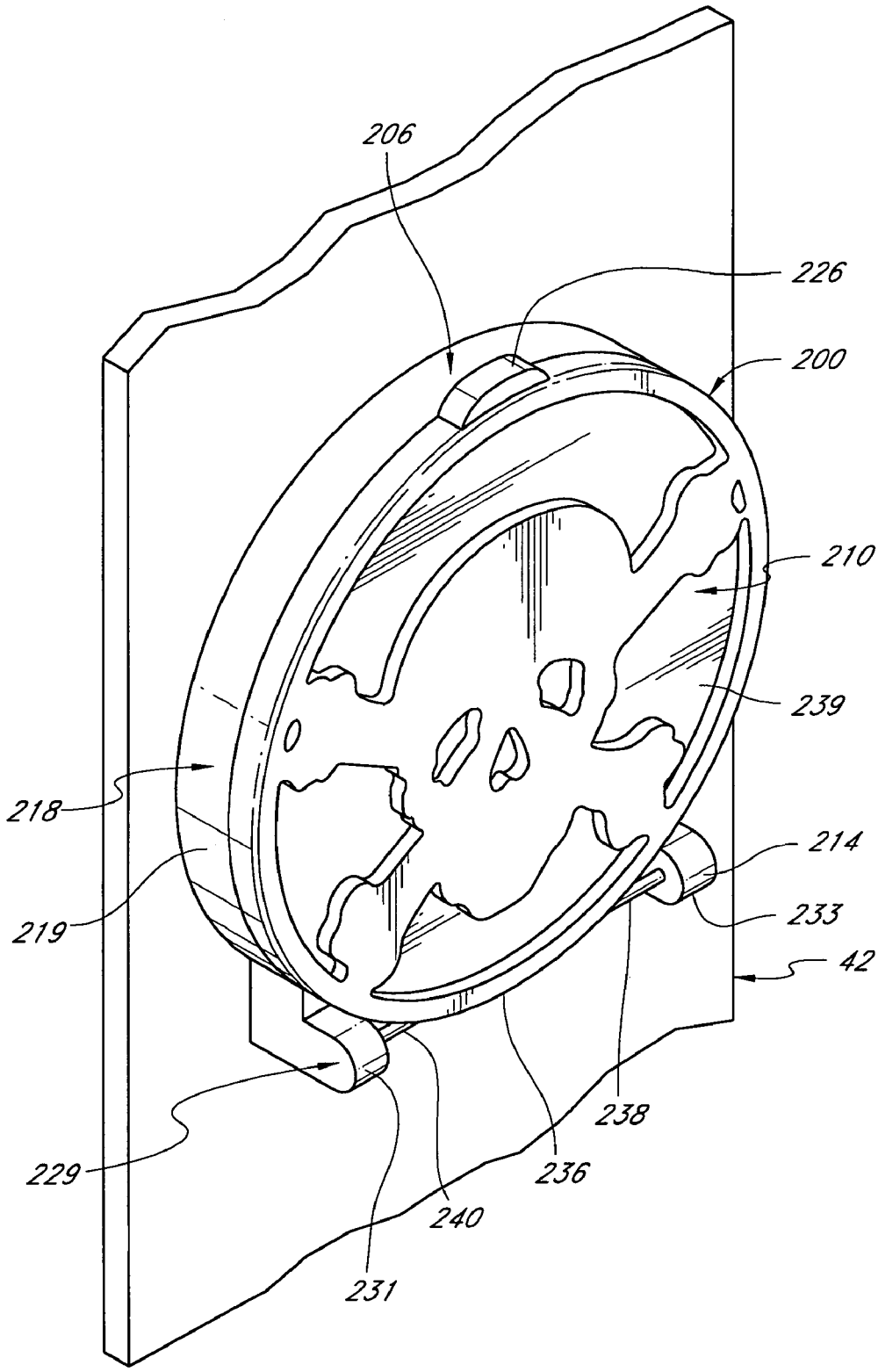
FIG. 9 is a front view of the accessory for holding items attached to a strap, wherein the accessory is in a closed position.

FIG. 9 illustrates an accessory 200 in the form of a receptacle attached to the guitar strap 42. The illustrated receptacle 200 comprises a base 206 and a lid 210. Generally, the base 206 is attached to the strap 42 and the lid 210 is removably coupled to the base 206. The lid 210 is illustrated in a closed position such that item(s) can be stored in the receptacle 200. The receptacle 200 can also have a means for securing the lid 210 over the base 206. The lid 210 can be moved from the closed to an open position in order to remove contents within the receptacle 200. The receptacle 200 preferably comprises a mechanism 229 that mechanically connects the lid 210 to the base 206 by permitting pivotal movement of the lid 210 with respect to the base 206.

Figure 10:
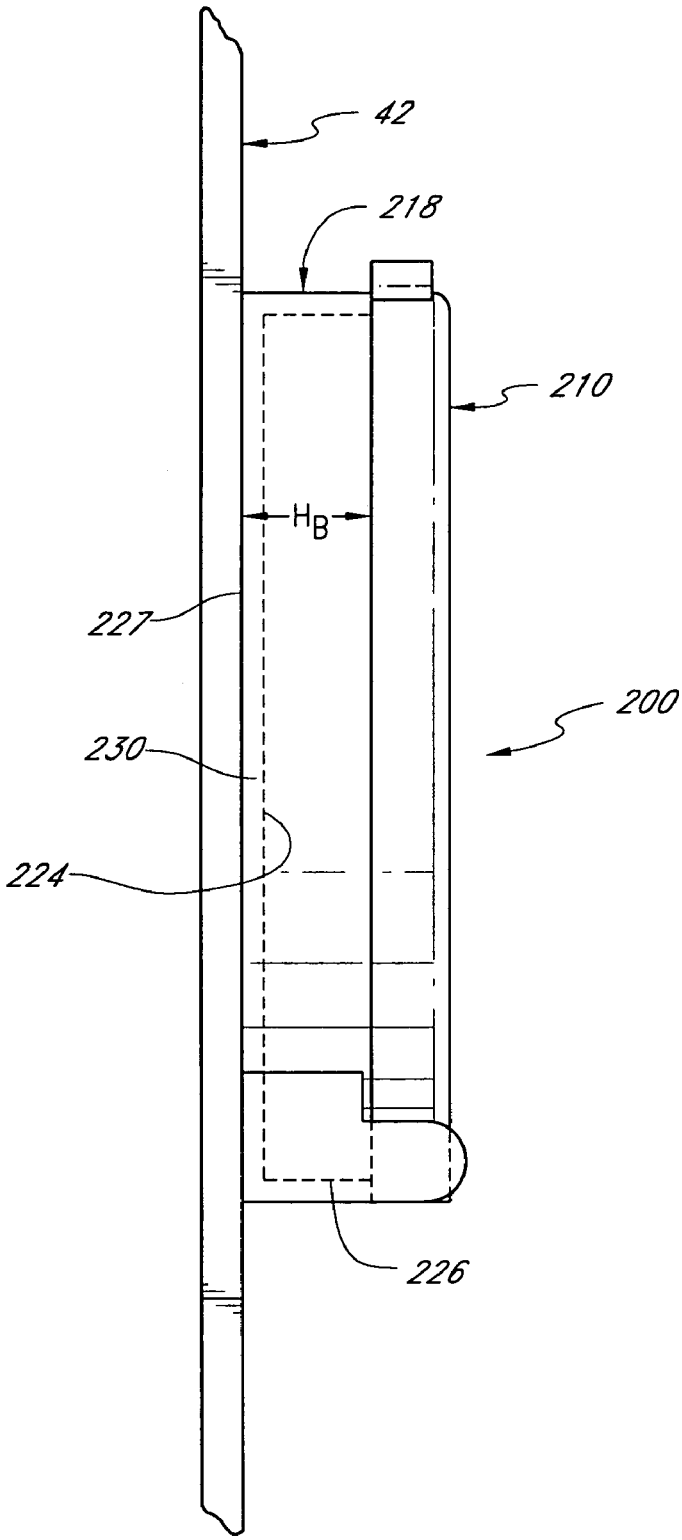
FIG. 10 is a side view of the accessory and the strap of FIG. 9.

The base 206 comprises a housing 218 that extends outwardly from the strap 42. The housing 218 has an outer surface 219. As shown in FIG. 10, the housing 218 and the lid 210 cooperate to define a chamber 226, preferably a closed chamber. The housing 218 has a back wall 230 that has an inner surface 224 and a back wall outer surface 227. The inner surface 224 defines a portion of the chamber 226, and the back wall outer surface 227 is configured to mate with the strap 42.

Figure 11:
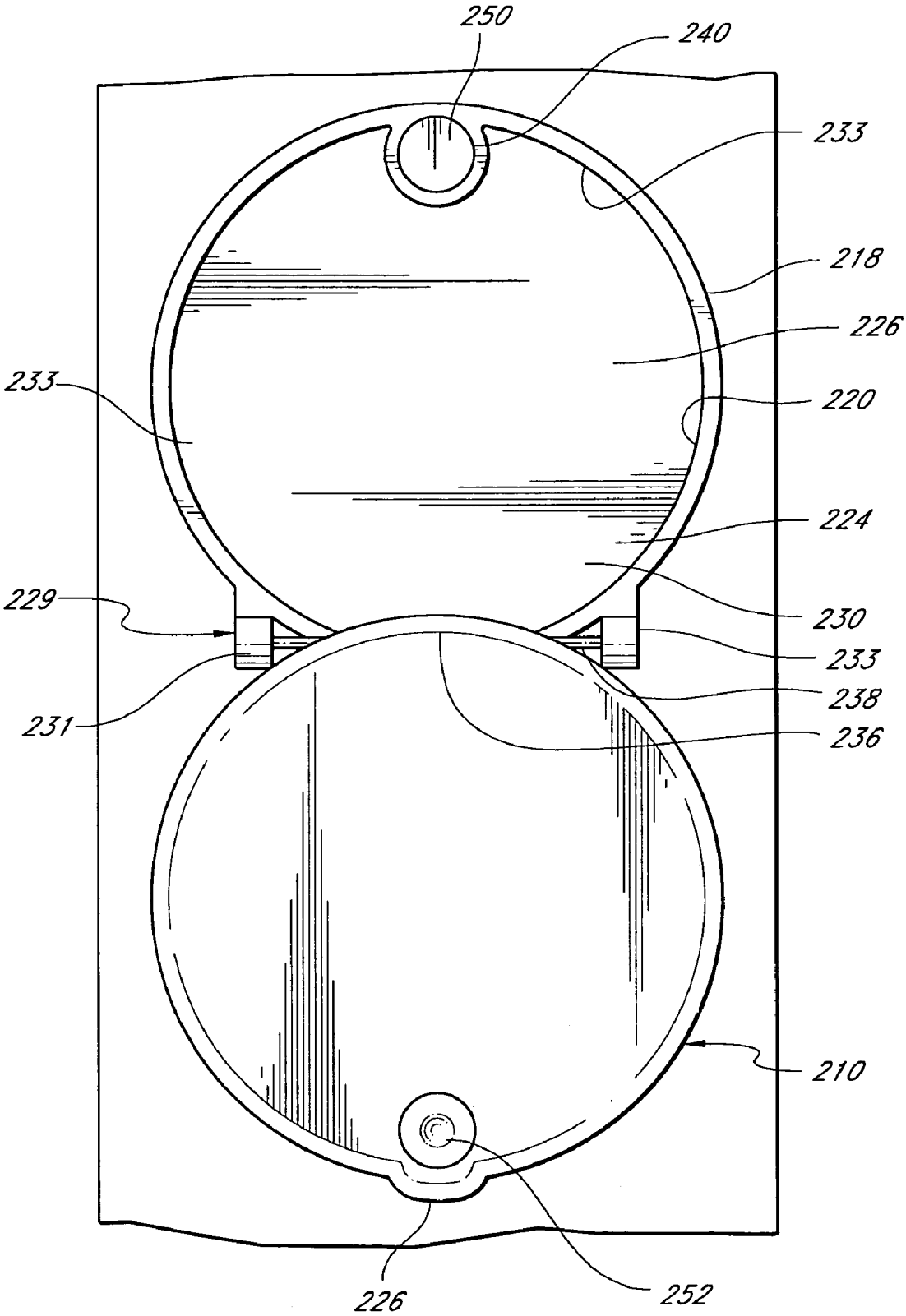
FIG. 11 is a front view of the accessory of FIG. 9 in an open position.

As shown in FIG. 11, the housing 218 is a generally cylindrical wall that defines an inner surface 220 and extends outwardly from the back wall 230. The housing 218 defines the sides of the chamber 226 and can be integrally formed with the back wall 230.

When the lid 210 is in a closed position illustrated in FIGS. 9 and 10, the lid 210 and the housing 218 define the chamber 226 having a volume configured and sized to hold one or more items, such as equipment for an instrument (e.g., a pick, including a guitar pick, string, reed, cork grease), foodstuffs (e.g., candy), medication, clothing, jewelry (e.g., a rings, bracket), cosmetics (e.g., lipstick), and the like. The receptacle 200 can loosely hold these items. In one embodiment, the receptacle 200 holds items (e.g., guitar picks) such that the items can slide freely about or within the chamber 226. In some non-limiting exemplary embodiments, the chamber 226 can have a volume in the range of about 0.2 inches$^3$ to about 2 inches$^3$. In some embodiments, the chamber 226 has a volume in the range of about 0.5 inches$^3$ to about 1.25 inches$^3$. In yet other embodiments, the chamber 226 has a volume equal to or greater than about 0.25 inches$^3$. The housing 218 can have a width W or diameter in the range of about 1 inch to about 2 inches. As shown in FIG. 10, the height $H_B$ of the housing 218 can be greater than about 0.1 inch. In some embodiments, the height $H_B$ is preferably less than about 0.75 inch. Alternatively, the receptacle 200 can tightly hold items to ensure that the items do not move relative to the receptacle 200.

With reference to FIG. 11, the base 206 defines a receptacle opening 233 defined by the edge of the housing 218. The opening 233 is configured so that a person's finger can be passed therethrough. In some embodiments, the opening 233 is configured so that a person's finger and thumb can be passed therethrough to grab one or more items held within the base 206. The opening 233 can be generally circular, polygonal (including rounded polygonal), elliptical, or other suitable shape for permitting items to be place into and/or removed from the base 206.

The lid 210 can be actuated between a closed position and an open position. When the lid 210 is in the closed position illustrated in FIG. 9, the lid 210 prevents items from escaping from the chamber 226. To remove items from the chamber 226, the lid 210 can be moved to a partially or completely opened position (illustrated in FIG. 10) to expose the contents within the receptacle 200.

With reference to FIGS. 9 and 11, the base 206 includes a mechanism 229 in the form of a hinge for movably holding the lid 210. The mechanism 229 preferably comprises a pair of holders 231, 233 disposed at either end of an elongated member 238 in the form of a shaft. Each of the holders 231, 233 is configured to receive an end of the shaft 238 such that the shaft is rigidly or rotatably held therebetween. The holders 231, 233 are spaced apart such that the end 236 and the lid 210 can be interposed between the holders 231, 233. Although the mechanism 229 is located at an outer edge of the base 206 and the lid 210, the mechanism 229 may not be located at the extreme edges of the base or lid. A skilled artisan can select the design of the mechanism 229 to achieve the desired movement of the lid 210. For example, the mechanism 229 can be a hinge (e.g., a living hinge) that connects the base 206 and the lid 210, wherein the receptacle is made of plastic formed by, e.g., an injection molding process.

As used herein, the term "lid" is a broad term and is used in its ordinary meaning and includes, without limitation, a closure, cover, or the like suitable for closing the receptacle 200. The lid 210 preferably comprises a protrusion or tab 226 at one end and the opposing end 236 is attached to the mechanism 229. The protrusion 226 extends outwardly from the lid 210 to form a convenient gripping structure for applying a force to the lid 210. In other embodiments, the lid 210 can have other configurations and designs for a user to easily engage and articulate the lid 210. For example, the lid 210 may have an outer edge or flange that extends outwardly from the base 206 when the lid is in a closed position. The end 236 has a through-hole configured to surround the shaft 238 of the mechanism 229. There can be play between the through-hole and the shaft 238 so that the lid 210 can pivot about the shaft 238. Alternatively, the lid 210 can be connected to the shaft 238, which has ends pivotally connected to the base 206. Optionally, an outer surface 239 of the lid 210 defines an eye-catching design.

With continued reference to FIG. 11, the receptacle 200 can have a closing system 240 configured to hold the lid 210 in the closed position. The closing system 240 comprises a first magnetic portion 250 of the base 206 that is configured to interact with a second magnetic portion 252 of the lid 210. When the lid 210 is in the closed position, the first portion 250 can be located proximate the second portion 252 to produce a magnetic field which causes the magnets 250, 252 to be drawn towards each other, such that the lid 210 remains in the closed position as the wearer plays the guitar. To open the receptacle 200, the user can place the finger on the tab 226 and apply an outwardly directed force that overcomes the magnetic field of the system 240 in order to rotate the lid 210 about the shaft 238 and away from the base 206. The lid 210 can be moved from an open position towards the base 206 until the magnetic members 250, 252 cooperate to generate a magnetic field that biases the lid 210 to the closed position.

Alternatively, the closing system 240 can be in the form of a latch, hook and loop fasteners, or other structure(s) for inhibiting or preventing the movement of the lid 210 relative to the base 206. In some embodiments, a plurality of magnets can couple the lid 210 to the base 206. For example, the base 206 can have a plurality of magnets 250 spaced about its periphery. The lid 210 can likewise have a plurality of similarly spaced magnets 252 spaced about its periphery. In other embodiments, the lid 210 is completely removable from the base 206 (i.e., the receptacle 200 does not have a mechanism 229). The magnets 250, 252 can cooperate to hold the lid 210 on the base 206. The lid 210 can be pulled to completely remove the lid 210 from the base 206. Alternatively, the lid 210 can have one or more flanges for releasably coupling to the base 206. For example, the lid 210 can be snapped onto the base 210 with flanges.

In some embodiments, a kit can comprise one or more of the accessories described above and a strap 42. Optionally, the kit can also comprise a lighter, drinking container (e.g., a flask), one or more picks, and/or other items suitable for engaging the accessory. In one non-limiting exemplary embodiment, the kit comprises the holder 46 and the lighter 52. In another non-limiting exemplary embodiment, the kit comprises the receptacle 200 and one or more picks (e.g., a guitar pick). The accessory can be attached to the strap 42, or separate from the strap 42 for subsequent assembly. Optionally, the kit can also comprise a means for attaching the accessory to the strap. Optionally, the kit can also comprise a musical instrument, such as a guitar.

Although not illustrated, a modified accessory of the strap assembly 41 can have a combination of features of the accessories described above. For example, an accessory can be configured to hold a lighter and open a bottle. A modified embodiment of the holder 46 illustrated in FIG. 3 has a bottle opener in the form of a receiving window, which can be similar to the receiving window 148 of the bottle opener 146 of FIG. 7. Thus, a skilled artisan will recognize the interchangeability of various features from different embodiments disclosed herein. Additionally, a plurality of the accessories can be attached to a single strap 42. For example, the holder 46 and receptacle 200 can be attached to a single strap 42. Thus, the strap assembly 41 can be capable of holding a lighter, holding a drinking container, holding items such guitar picks, opening drinkware, etc. Additionally, the accessory can be in the form of one or more straps, including bands, ties, and the like, used to hold an article.

The accessories described herein can be used attached to various types of straps. For example, the accessories can be attached to a strap of a backpack, luggage, purse, bag, and the like. In some embodiments, the accessory is coupled to one of the straps of a backpack. In some embodiments, the accessories are attached to bags designed to transport, for example, musical instruments, music equipment or accessories, and the like.

Similarly, the various features and steps discussed above, as well as other known equivalents for each such feature or step, can be mixed and matched by one of ordinary skill in this art to perform methods in accordance with principles described herein. Additionally, the methods which is described and illustrated herein is not limited to the exact sequence of acts described, nor is it necessarily limited to the practice of all of the acts set forth. Other sequences of events or acts, or less than all of the events, or simultaneous occurrence of the events, may be utilized in practicing the embodiments of the invention.

The materials, methods, ranges, and embodiments disclosed herein are given by way of example only and are not intended to limit the scope of the disclosure in any way. Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. A musical instrument strap assembly and lighter kit comprising:

a musical instrument strap having ends configured to attach to a musical instrument;

a holder attached to the musical instrument strap and defining a chamber configured to receive and hold a lighter, wherein the holder comprises:

a first sidewall having a long axis;

a second sidewall, a long axis of which is substantially parallel to the long axis of the first sidewall;

a front portion connecting the first sidewall and second sidewall; and a bottom connected to at least one of the first sidewall, the second sidewall, the strap, and the front portion;

wherein the first sidewall, the second sidewall, the front portion, and the bottom define boundaries of the chamber; and wherein the holder defines a top opening to the chamber, the opening adapted to permit at least a portion of a lighter to slide into and out of the chamber; and the lighter, configured to be held by the holder.

2. The musical instrument strap assembly of claim 1, wherein the opening is adapted to receive a lighter that is substantially rectangular in cross section.

3. The musical instrument strap assembly of claim 1, wherein the opening is adapted to receive a lighter that is substantially elliptical in cross section.

4. The musical instrument strap assembly of claim 1, wherein the holder comprises a member defining at least a portion of the chamber, the member is movable between a first when the chamber is empty and a second position when a lighter is positioned within the chamber.

5. The musical instrument strap assembly of claim 1, further comprising at least one fastener extending through the musical instrument strap and being attached to the holder.

6. The musical instrument strap assembly of claim 5, wherein a substantial portion of the holder is substantially rigid such that the holder retains its shape when a lighter is not disposed in the chamber.

7. The musical instrument strap assembly of claim 1, wherein the chamber has a height of more than about 1 inch and a width less that extends over the edge of the strap by at least about ¼ inch on each side.

8. The musical instrument strap assembly of claim 1, wherein the holder is connected to a front portion of the musical instrument strap, and the front portion of the musical instrument strap is configured to be positioned in front a person when the person wears the musical instrument strap to support a musical instrument.

* * * * *